US009227803B2

(12) United States Patent
Brunschwiler et al.

(10) Patent No.: US 9,227,803 B2
(45) Date of Patent: Jan. 5, 2016

(54) DEVICE AND METHOD FOR SEPARATING PRODUCT PARTS OF A MULTI-PART PRODUCT

(71) Applicant: Ferag AG, Hinwil (CH)

(72) Inventors: Othmar Brunschwiler, Bettwiesen (CH); Erwin Stauber, Grut (CH)

(73) Assignee: FERAG AG, Hinwil (CH)

( * ) Notice: Subject to any disclaimer, the term of this patent is extended or adjusted under 35 U.S.C. 154(b) by 0 days.

(21) Appl. No.: 14/455,315

(22) Filed: Aug. 8, 2014

(65) Prior Publication Data

US 2015/0042029 A1 Feb. 12, 2015

(30) Foreign Application Priority Data

Aug. 12, 2013 (CH) ..... 1382/13

(51) Int. Cl.

| | |
|---|---|
| ***B65H 5/30*** | (2006.01) |
| ***B65H 39/065*** | (2006.01) |
| ***B65H 5/02*** | (2006.01) |
| ***B65H 5/36*** | (2006.01) |

(52) U.S. Cl.

CPC ..... *B65H 5/30* (2013.01); *B65H 5/021* (2013.01); *B65H 5/305* (2013.01); *B65H 5/36* (2013.01); *B65H 39/065* (2013.01); *B65H 2301/432* (2013.01); *B65H 2301/431716* (2013.01); *B65H 2301/44732* (2013.01); *B65H 2301/44765* (2013.01); *B65H 2404/64* (2013.01); *B65H 2405/57* (2013.01); *B65H 2405/5812* (2013.01); *B65H 2701/1932* (2013.01)

(58) Field of Classification Search

CPC ..... B65H 5/30; B65H 5/305; B65H 5/306; B65H 5/307

USPC ..... 221/52.23, 52.25; 270/52.23, 52.25

See application file for complete search history.

(56) References Cited

U.S. PATENT DOCUMENTS

| | | | | |
|---|---|---|---|---|
| 1,202,809 | A | | 10/1916 | Curry |
| 1,441,278 | A | | 1/1923 | Halvorsen |
| 3,580,562 | A | | 5/1971 | Reist |
| 3,595,560 | A | | 7/1971 | Hannon |
| 3,722,877 | A | | 3/1973 | Wetter |
| 4,046,763 | A | * | 9/1977 | Schwartz et al. ..... 544/410 |
| 5,823,320 | A | * | 10/1998 | Seidel et al. ..... 198/803.5 |

(Continued)

FOREIGN PATENT DOCUMENTS

| | | |
|---|---|---|
| EP | 0336062 | 10/1989 |
| JP | 2010143667 | 7/2010 |

*Primary Examiner* — Patrick Mackey

(74) *Attorney, Agent, or Firm* — Rankin, Hill & Clark LLP

(57) ABSTRACT

The device for separating product parts of a multi-part, flat product includes a receiving unit for receiving the product, a device for separating the product parts and a retaining device for acting on one of the product parts for the purpose of maintaining the separation of the product parts. The receiving unit includes a first friction element and a second friction element, which is movable with respect to the first friction element. The two friction elements are arranged on the receiving unit such that the product can be firmly clamped between the friction elements. The friction elements are designed such that the static friction between the product part and the friction element assigned to this is greater than the static friction between the product parts, so that the product parts can be moved with respect to one another given a relative movement between the two friction elements firmly clamping the product.

10 Claims, 13 Drawing Sheets

(56) References Cited

U.S. PATENT DOCUMENTS

| | | | | |
|---|---|---|---|---|
| 6,234,466 | B1 * | 5/2001 | Infanger | 270/52.23 |
| 6,311,968 | B1 * | 11/2001 | Linder et al. | 270/52.25 |
| 6,612,567 | B1 * | 9/2003 | Kaya | 271/206 |
| 6,691,996 | B2 * | 2/2004 | Kaya et al. | 270/52.25 |
| 6,705,608 | B2 * | 3/2004 | Kish et al. | 271/206 |
| 6,764,073 | B2 * | 7/2004 | Kaya et al. | 271/223 |
| 6,830,241 | B1 * | 12/2004 | Klopfenstein | 270/52.25 |
| 6,830,541 | B2 * | 12/2004 | Wu | 482/54 |
| 8,419,004 | B2 * | 4/2013 | Stauber | 270/52.14 |
| 8,523,164 | B2 * | 9/2013 | Tassinari | 270/52.19 |
| 2011/0284342 | A1 * | 11/2011 | Berni | 198/470.1 |

* cited by examiner

F
2
3
4a
4b
8
11a
11b
12
13a
13b
14
15
16
17a
17b
18
19
20
21
26
27a
27b
28
29a
29b
A
A
T
T

F
53
18
4b
17b
19
20
17a
4a
29b
54
21
13a
3
27b
T
14
2
15
11b
13b
B
16
27a
29a
28
26
12
11a
27a
13b
3
2
16
11b

DEVICE AND METHOD FOR SEPARATING PRODUCT PARTS OF A MULTI-PART PRODUCT

BACKGROUND OF THE INVENTION

The invention lies in the field of conveying and further processing of flat (two-dimensional) products, particularly printed products. The invention relates to a device for separating product parts of a multi-part, flat product, including a receiving unit for receiving a product, and methods for separating the product parts, wherein the receiving unit includes a first and a second friction element which are movable relative to one another, wherein the two friction elements are arranged on the receiving unit in a manner such that the product can be arranged and firmly clamped between the friction elements, and the friction elements are designed in a manner such that the static friction between the product part and the friction element assigned to this is greater than the static friction between the product parts, so that the product parts can be moved with respect to one another given a relative movement between the two friction elements firmly clamping the product.

The invention also relates to a method for separating the product parts of a multi-part, flat product amid the use of the device.

Folded printed products are featured by a fold edge, along which the printed product is folded and which forms a first and a second product part. The free edges of the product parts are arranged opposite to the fold edge.

Folded printed products, in the course of their further processing, as a rule must be opened at least once, in order to insert further printed products, such as newspaper parts, pamphlets, brochures, flyers or goods samples or other further, as a rule, flat supplements, between their product parts.

It is common for the one product part to include a so-called overlap, in order to simplify the opening of folded products or to render it possible at all. The overlap is a surface section on one of the product parts in the region of the free edge lying opposite to the fold edge. The so-called surface section is featured in that this projects beyond the free edge of the other product part. The one product part thus with respect to the other part forms an exposed region.

The overlap can be created for example by way of incorporating a fold which is arranged asymmetrically, i.e., in an out-of-centred manner.

Such an overlap thus permits the gripping or fixing for example of the one product part on the overlap, e.g., by way of a clip. The two product parts then for example can be moved apart in a manner supported by gravity, wherein the other product part must be held. The printed product can be quickly and simply opened in this manner.

At this location, the European patent publication EP 2 297 014 B1 is to be mentioned as representative for a multitude of patent applications which have opening devices operating according to the opening principle defined above, as their subject matter.

The document EP 2 297 014 B1 describes a device for opening and inserting flat objects into a folded printed product. The device includes a circulating system with a plurality of compartments which are movable about a rotation axis along a closed, circular circulating path. The compartments include compartment bases which are delimited in the circulating direction by way of partition walls. The compartments moreover along the periphery include openings for inserting the printed products. The compartments in each case include a clip, by way of which the overlap of a trailing product part is firmly held on the trailing compartment wall.

The compartments are led downwards along an arched path, wherein the compartment openings on the outer periphery are moved downwards. With this procedure, the leading product part on account of gravity pivots downwards onto the oppositely lying, leading compartment wall, whereas the trailing products part is held by the clip limbs on the trailing compartment wall. The printed product opens, and the supplement can be inserted in this manner.

Since, as a rule, an overlap is not desirable with the end product, for example with a newspaper ready for dispatch, this must be eliminated at the end of the processing. This as a rule is effected by way of a cutting procedure. A high quantity of waste in the form of paper strips arises with this processing step.

The creation of an overlap for the simplification of the processing of printed products causes a significant quantity of cut waste which must be disposed of with a corresponding expense. Moreover, suitable assemblies are to be provided, which are capable of separating away the overlap again. Apart from ecological aspects, from an operational economical point of view, it is also the additional consumption of raw material and thus the additional costs which are important, without an additional use resulting therefrom with the end product.

If one could make do without an overlap in the further processing, then this would mean a significant saving of material. The saving of material as a result would lead to a reduction of production costs. Moreover, such a material saving would also contribute to taking care of resources. Moreover, a working step which contains the separating away of the overlap could also be omitted due to making do without the overlap.

Since the overlap as a rule merely serves for opening the printed product, as a result a device which is in the position of opening printed products without an overlap would be quite useful. Thereby however, one should consider the fact that the opening of the printed products is not only a very important, but also a very delicate method step. The opening and the holding-open of the products specifically on the one hand should be effected in a rapid and reliable manner, but on the other hand the product should be treated as gently as possible with this procedure, so that it is not damaged.

Thus the document EP 0 600 216 A1 with FIG. 8 describes a device and a method for opening a two-fold printed product without an overlap. For this, a vacuum is applied onto the outer surface of a first product part by way of a vacuum source. The first product part is held on a gripper tongue due to the produced suction pull, whilst the oppositely lying second product part moves away from the first product part on account of gravity. The installation and the operation of a vacuum device with vacuum conduits to the respective active locations however are extremely cumbersome and prone to disturbance. This is particularly the case with those operational types, with which the product must be opened during the conveying movement.

BRIEF SUMMARY OF THE INVENTION

It is therefore the object of the present invention, to suggest a device which is capable of separating product parts of a multi-part, flat product which bear on one another, from one another in a manner such that a subsequent opening of the product for example can be carried out without any problem.

The term "separating" is to be understood as the separation of two product parts bearing or lying on one another, starting from a free product edge, in particular from the free product edge lying opposite the fold edge, amid the formation of a gap between the two product parts. The term "separating" inasmuch as this is concerned differs from the term "opening" in that the gap between the two product parts which is produced by the separation can be smaller than the gap produced on opening the product for the purpose of inserting a supplement.

The multi-part, flat products according to the present invention, particularly can be printed products, such as brochures, newspapers, magazines or periodicals.

The multi-part, flat products disclosed in the present invention include at least two product parts which are connected to one another at a connection edge. The product parts particularly are flexibly designed. The individual product part can be single-sheet or multi-sheet. The product parts at an edge running perpendicularly to the connection edge can be connected to one another via a further connection edge.

The connection edge can be a fold, a spine, a folded edge or a fold edge. The product parts can be connected to one another at the connection edge via a fold edge, a bonding connection, a seam, a ring tie or a stitching, such as thread stitching or wire stitching or stapling. Other suitable combination techniques are likewise possible.

The multi-part flat products can also include several part products, such as newspaper folds, which are inserted into one another and in particular are folded. The part products themselves can include several product parts, particularly two product parts, which are connected to one another via a connection edge.

The products moreover form an opening side which lies opposite the connection edge. The sheets of the product parts form free edges at the opening side of the products. The term "Free edge" means that the sheets are not connected to one another via a fold or in any other manner.

The individual product parts can include one, two or more than two sheets. The latter can be the case for example if the products are folded several times.

The product can moreover likewise in each case form a lateral, free edge between the fold edge and the free edge. However, it is also possible for the product between the fold edge and the free edge at the one side to form a lateral free edge and at the oppositely lying side a lateral fold edge.

The device according to the invention and the associated method for example are particularly suitable for products without an overlap. "Without an overlap" for example can mean that the products are folded in the middle.

The products for example can be folded once. Each product part in this case can be designed in a single-sheet manner. The product for example can be envelopes or folded signatures.

Moreover, the device and the associated method are also particularly suitable for two-fold printed products. The latter are firstly folded once and then a second time at right angles thereto.

The device is then featured in that the receiving unit includes pressing devices with a pivot device, by way of which the first friction element can be pressed against the second friction element, wherein the pivot device includes a pivot element mounted on a guide pivot, by way of which pivot element the first friction element can be pivoted to the second friction element, wherein the pivot element is rotatably or pivotably, as well as axially displaceably mounted with respect to the guide pivot.

The device further particularly includes a retaining device with a retaining element for acting on at least one of the product parts for the purpose of maintaining the separation of the product parts.

The associated method is featured by the following steps:

introducing a multi-part, flat product into the receiving unit, wherein the product parts are arranged between the two friction elements;

pivoting the pivot element about the guide pivot and, by way of this, pressing the first friction element against the second friction element and firmly clamping the product arranged between the friction elements;

axially displacing the pivot element along the guide pivot and, by way of this, moving the first friction element with respect to the second friction element transversely to the pressing direction and displacing the product parts to one another, so that the one product part in each case forms an exposed region with respect to the second product part;

introducing a retaining element into the exposed region;

releasing the clamping of the product by way of pivoting back the pivot element, and, by way of this, restoring the first friction element.

As least the one product part undergoes an elastic deformation due to the displacement of the product parts laterally to one another, and this deformation is manifested for example in the form of an arching.

On releasing the clamping of the product after the separation of the product parts, the displaced product part due to its intrinsic tension/stress again assumes the initial position and shape. This means the deformation is undone and the exposed region then recedes. With this procedure, the retaining element which had previously moved into the exposed region comes to lie between the product parts and continues to distance these to one another.

Thus the accessibility for introducing a retaining element between the product parts is created with the present method. The introduction of the retaining element for example serves as a preparation for a subsequent opening of the product.

The relative movement between the two friction elements for example runs parallel to the surface plane of the folded product.

The friction elements for example can be arranged at least partly lying opposite one another.

The friction elements usefully form a contact surface to the product or to the product parts. The contact surfaces particularly are designed such that the static friction coefficient between in each case the contact surface and the product part bearing on this is greater than the static friction coefficient between the product parts which are moved with respect to one another amid the formation of an exposed region. On account of this, the product parts are moved with respect to one another, particularly displaced to one another, given a relative movement between the two friction elements.

The contact surface can include an elastomer, particularly a rubber. The contact surface can have adhesive characteristics.

The first friction element during the relative movement for example bears on the first product part at least in a part-surfaced manner. Moreover, the second friction element during the relative movement for example likewise bears on the second product part at least in a part-surfaced manner, which is to say over part of the surface.

The retaining device for example can include a clamping device for the clamped holding of the one product part on the receiving unit. For this, a retaining element in the embodiment of a clip limb is moved into the exposed region. In the holding position, the clip limb cooperates with a further component, so that the product part is firmly clamped in the exposed region.

This further component can be part of the receiving unit, particularly a support structure such as a wall, of the receiving unit. The mentioned component can also be a second clip limb.

The retaining device can however also be an infeed element which is moved into the exposed region and thus prevents a renewed uniting of the product parts.

The retaining device or the retaining element can be actuated via a guide mechanism.

The receiving unit for receiving the product can include a compartment, at least a part of a compartment or a pocket. The receiving unit can form a base, to which the product with its connection edge is introduced into the receiving unit.

The base can be adjustable, in a manner such that the insertion depth or push-in depth can be adjusted and for example adapted to the product format.

The receiving unit can include side delimitation elements such as lateral guide plates which laterally guide or align the products. The side delimitation elements thus form a lateral guide or a lateral abutment. The receiving unit moreover can include adjustment devices which permit the adjustment of the side delimitation elements, particularly the setting of the distance between the side delimitation elements. The adjustment devices can for example include elongate holes, in which fastening devices such as screw connections are releasably and displaceably guided.

The side delimitation elements and/or the adjustment devices can be provided in the leading or the trailing support structure, in particular wall, of the receiving unit.

The receiving unit can include an opening, via which the product is inserted into the receiving unit, and to which the free edge of the product introduced into the receiving unit is directed.

The receiving unit can include a first, particularly leading, and a second, particularly trailing, support structure on which the product parts can bear in a surfaced, which is to say extensive manner.

The support structure is particularly designed as a wall.

The terms "leading" and "trailing" in the present patent application relate to the movement direction of the receiving unit or conveying direction of the products.

The device can also be designed as a revolving device, in which the receiving units are moved along a closed conveying path. The revolving device for example can be designed as a rotation body with a rotation axis. The receiving units for example are arranged along the outer periphery of the rotation body with radially outwardly facing openings.

The device particularly can be an inserting device which is designed for opening the products and for inserting supplements between the product parts of opened products.

The receiving unit can include pressing devices which permit the firm clamping of the product or its product parts between the friction elements. Thus for example the one friction element, hereinafter called first friction element, can be pressed by way of the pressing devices against the other friction element, hereinafter called second friction element. The pressing devices for example can exert a pressing force onto the product via the friction element, the force being directed transversely to the surface plane of the product.

The pressing devices for example can include a spring-elastic element which produces a restoring force. Thus the pressing force for example can be produced by this restoring force. Conversely, the spring-elastic element can also be designed for moving the friction element via the restoring force out of a pressing position into an inactive position, i.e., the restoring force counteracts a pressing force.

The pressing devices can cooperate with a guide mechanism, via which a counterforce on the pressing devices and acting opposite to the restoring force can be produced. For example, the friction element can be led back into an inactive position releasing the clamping or into a pressing position via this counterforce.

The pressing devices can include a guide element which is attached on the receiving unit and which can be moved along a stationary guide. The guide element which is actively connected to the friction element is actuated via the guide mechanism. A counterforce which is transmitted onto the friction element is produced by way of actuating the guide element.

The pressing devices can contain a pivot device, by way of which the friction element can be pivoted into a pressing position and can be pivoted back out of the pressing position into the inactive position.

One can envisage the pressing devices acting on the first and/or the second friction element, and accordingly the first and/or second friction element pressing against the other friction element.

The receiving unit can include activation devices, by way of which the two friction elements pressed against one another and clamping the product can be moved laterally to one another in a relative movement.

The activation devices can be rotation devices which can set the first, the second or both friction elements into a rotation movement. The rotation devices effect a rotation of the friction elements relative to one another. The rotation axis for example lies perpendicularly to the surface plane of the product or of the contact surface.

The activation devices can also be designed as displacement devices which are designed for the lateral displacement of the friction elements relative to one another. The displacement can be parallel to the surface plane of the product. The displacement devices can be designed for the displacement of the friction elements relative to one another and transverse to the pressing direction.

The activation devices for example can include a restoring element which cooperates with a guide mechanism, via which a counterforce counteracting the restoring force of the restoring element can be produced. The friction element concerned can be moved in two directions by way of this, specifically in the direction of the restoring force of the restoring element and in a direction which is opposite to the direction of the restoring force.

The activation devices can include a guide element which is attached on the receiving unit and which can be moved along a stationary guide. The guide element which is actively connected to the friction element is actuated via the guide mechanism. A movement which is transmitted onto the friction element is triggered by way of actuating the guide element.

One can envisage the activation devices acting on the first and/or second friction element and accordingly the first and/or second friction elements moving with respect to the other friction element.

In accordance with the present invention, the pressing devices as well as the activation devices act on the first friction element, i.e., the first friction element is pressed against the second friction element as well as moved laterally with respect to this. The second friction element for example can be fixed with respect to the receiving unit, i.e., not moved.

The pivot element in particular includes a pivot arm. In particular, the first friction element is arranged on the at least one pivot arm at a radial distance to the guide pivot or axis.

Moreover, a restoring spring, particularly in the design of a compression spring, which effects and axial restoring of the pivot element on the guide pivot, is arranged on this guide pivot.

The pivot element particularly is mechanically actively connected to a restoring element which exerts a restoring force on the pivot arm in the direction of an inactive pivot position. The restoring element can be a tension spring. The pivot element in particular can be connected to this restoring element via a pull element.

The pivot element particularly is mechanically actively connected to a guide element which cooperates with a guide mechanism. The guide element is moved, particularly pivoted via the guide mechanism. The guide element is then mechanically actively connected to the pivot element in a manner such that this pivot element, via a movement activated by the guide mechanism, is capable of: pivoting the pivot arm with the friction element to the product and pressing it onto this, and displacing the pivot arm along the guide pivot counter to the restoring force of the compression spring, so that the second friction element displaces with respect to the first friction element.

The guide mechanism can be stationary with respect to the receiving unit. The guide element can be connected to the pivot arm via a pull element.

The receiving unit can include two or more than two first friction elements. The receiving unit can also include two or more than two second friction elements.

In accordance with the present invention the design is preferably such that the two friction elements in their active position, but before the lateral movement, firmly clamp the printed product in the upper half, particularly in the upper quarter, which faces the free product edge. The two friction elements in their active position can firmly clamp the printed product in particular in the direct proximity to the free edges.

The friction elements as well as the pressing devices, the activation devices and/or the retaining devices are preferably designed as part of the receiving unit. For example, they can be moved together along a conveying path. This permits the implementation of the method according to the invention during the movement of the receiving unit along the conveying path and accordingly during the conveying of the products along the conveying path.

The opening of the products can be effected after the separation of the product parts, e.g., by way of pivoting the receiving unit. The receiving units for this can be pivotably held on a circulating device.

The pivoting for example is of such a type, that the leading product part due to gravity is further distanced to the trailing product part. The trailing product part is held by the clip with this procedure.

The receiving unit can include an integrated opening aid. This opening aid can render the opening of the printed product by way of pivoting the pocket, as described hereinafter, superfluous or at least support this.

The opening aid includes at least one deformation element which is integrated into the trailing pocket wall. This for example can be of spring steel. The deformation element forms a deformation body, which is connected via a connection section to the trailing pocket wall. The deformation axis leads through the connection element and the deformation body. The deformation body forms a first contact surface which is arranged on the first side of the deformation axis, and a second contact surface which is arranged on the second side of the deformation axis.

The deformation element can be designed as a torsion element.

The deformation element is designed in such a manner, and integrated into the trailing pocket wall, such that the deformation body can be twisted with respect to the pocket wall by way of exerting a pressing force onto the first contact surface by way of a pressing element via the connection section.

The pressing force on the first contact surface can be produced by way of a retaining element, particularly by a clip limb which simultaneously firmly clamps the trailing product part on the trailing pocket wall. The deformation axis in this case can run parallel to the pivot axis of the clip limb.

Since the first contact surface lies outside the deformation axis, the pressing force which is exerted by the push element, particularly by the clip limb, onto the first contact surface causes a twisting of the deformation body. With this procedure, the push-loaded first contact surface draws back, whereas the second contact surface which lies on the other side of the deformation axis is moved forwards in the direction of the bearing product part. With this procedure, the second contact surface forms an arching into the trailing product part. This arching in turn acts on the leading product part and pushes this away in the direction of the leading pocket wall. The product parts in this manner are separated further which is to say the product is opened.

The opening aid which is described above can also be considered as an independent aspect of the invention.

The present invention has the advantage that the product parts can be separated in a gentle and rapid manner by way of a comparatively simple and robust mechanism. The mechanism can be integrated simply and without any problem into the receiving units. Accordingly, the mechanism or mechanics are co-moved with the receiving units, so that the product parts of the printed products can be separated and subsequently opened, also during the conveying of the products.

Interfaces to the stationary elements of the device if need are be created by way of known guide mechanisms which have proven their worth.

A further, independent aspect of the invention relates to a device for opening a multi-part, flat product with a first and with a second product part. The first product part is a leading product part. The second product part in particular is a trailing product part. The product is a printed product which is already described above.

The device further includes a receiving unit for receiving the product. The receiving unit includes a first support structure and a second support structure for supporting the product parts in the receiving unit. The first support structure is a leading support structure. The second support structure is a trailing support structure. The first product part faces the leading support structure. The second product part faces the second support structure.

The receiving unit includes a receiving compartment which is arranged between the two support structures and is for receiving the product. Moreover, the device includes elements for holding the second product part on the second support structure.

The way and manner as to how the second product part is brought into the holding position on the second support structure after introduction of the product into the receiving unit, is not part of the present aspect of the invention. Thus the second product part can include an overlap, via which the second product part is held on the second support structure, without the product parts having to be separated prior to this.

Moreover, the product parts can be separated beforehand, in order to create an exposed region for holding the second product part on the second support structure. A device and a method for separating the product parts are described for example in the present invention. Accordingly, the present invention and the associated method can include additional device features and method features for this aspect of the invention. The two independent aspects of the invention as a result can be combined with one another with regard to the method as well as with regard to the device.

The present device then is featured in that the device includes a movement impulse transmission device with an impulse element with a pivot section, the impulse element being arranged on the first support structure and pivotably mounted, wherein the impulse element is pivotably mounted in a manner such that this, for opening the product, can act with its pivot section on the first product part by way of a pivot movement, in a manner such that at least that region of the first product part, in which the pivot section hits the first product part, moves to the second support structure.

The impulse element particularly is rotatably mounted on the first support structure. The impulse element particularly is mounted on a rotation pivot.

The impulse element can be arranged on a rotation rod. The impulse element is arranged on the rotation rod in a rotationally fixed manner. The rotation rod thereby forms the rotation pivot or axis of the impulse element. The rotation rod is rotatably mounted on the first support structure. The rotatable mounting can be effected via suitable fastening devices.

The rotation rod is coupled to a cam element via which a rotation movement of the rotation rod is activated and can be transmitted from the rotation rod onto the impulse element. The cam element can for example be a cam roller, a cam roller which is connected to the rotation rod via an arm. The cam roller can be guided by a guide mechanism.

The movement impulse transmission device in further accordance with the invention includes a restoring element. The restoring element causes the impulse element with its pivot section, subsequently to the pivoting-out, to be led back into an initial position due to its restoring force.

The restoring element can be a restoring spring, particularly a helical spring designed as a torsion spring.

The restoring element can be a restoring spring which is arranged on a rotation pivot, e.g., rotation rod, and which exerts a torque onto the rotation pivot. The rotation pivot and with this, the impulse element are rotated back in their initial position by way of the torque.

The impulse element with its pivot section, in the initial position of the first support structure can bear on the inner side which faces the receiving compartment.

The receiving unit can be a receiving pocket. The support structures can be pocket walls.

One aspect in accordance with the present invention, apart from the device also relates to a method for opening a multipart, flat product by way of the device described above. The method includes the following steps:

- introducing a product into the receiving unit;
- holding the second product part on the second support structure;
- pivoting the impulse element with its pivot section to the second support structure, and
- pushing back at least that region of the first product part, in which the pivot section hits the first product part, to the second support structure by way of the pivot section.

The impulse element with this procedure, with its pivot section hits the first product part, by which means a movement impulse is transmitted onto the first product part in the direction of the second support structure. The mentioned region of the first product part is moved to the second support structure by way of this.

The impulse element within a section can hit the first product part, which departing from the connection edge extends over two thirds of the total height of the product part in the receiving unit.

The impulse element hits the first product part in a middle section of the product. The middle section is arranged between the free edge of the opening side, at which the product is opened, and the oppositely lying connection edge. The middle section can extend over a third of the total height of the product.

An upper section of the first product part is moved to the first support structure by the movement impulse which is transmitted in the mentioned section by the pivot section onto the product. This upper section borders the free edge of the opening side, at which the product is opened. The upper section lies above that section, in particular above the middle section, in which the pivot section hits the first product part.

This procedure activates the opening of the product. The opening procedure is yet described in more detail further below.

The impulse element is arranged on the first support structure in a manner such that this on actuation, in the mentioned section transmits a movement impulse directed to the second support structure, onto the first product part.

If the impulse element is arranged on a rotation rod as mentioned further above, then a rotation movement is introduced into the rotation rod via the cam element for actuating the impulse element. The pivot section of the impulse element is pivoted or deflected out in the direction of the interior of the receiving unit by way of the rotation of the rotation rod, wherein a movement impulse is transmitted onto the first product part.

The receiving unit itself can likewise be pivotably mounted about a rotation axis. Thus the receiving unit can support the opening procedure due to the pivotability.

A further independent aspect of the present invention, which can be combined with previously described aspects of the invention, relates to delivery of flat product units from a revolving device. The revolving device includes a plurality of receiving units which are arranged along its periphery and which are with radially outwardly facing openings for receiving and delivering the product units. The receiving units are moved in the revolving device along a closed conveying path.

A product unit is to be understood as individual printed products, collections of printed products, stacks or bundles of printed products or printed products which are inserted into one another. The product unit can be flexible. The product units can also be other flat products.

The further aspect of the invention thus relates to a device and to a method for the delivery of flat product units from a revolving device. The device apart from the revolving device includes a conveying-away device for the controlled delivery of the product units from the receiving units of the revolving device and the transfer to a conveying-away unit.

The device then is featured in that the conveying-away device includes a circulating mechanism with a plurality of support bodies circulating along a closed circulating path. The support bodies in each case form a rest surface. The support bodies moreover each include a clamping element. The clamping element and the rest surface are each designed, and the support bodies arranged one after the other along the circulating path, such that the product unit with its opening-side product region is supported on the rest surface and can be clamped on the rest surface by way of the clamping element of a subsequent support body.

The associated method for delivering a flat product unit from a receiving unit is featured by the following steps:

conveying the product unit in the receiving unit along a circulating path into a delivery zone in the region of the conveying-away device;

feeding a support body into the delivery zone and supporting an openings-side product region on the rest surface of the support body;

feeding a further, subsequent support body and applying the clamping element of the subsequent support body onto the product region, and, by way of this, firmly clamping the product region on the rest surface of the support body running in front;

sliding the product unit out of the receiving unit by way of the further conveying of the receiving unit;

releasing the clamping and transfer of the product unit to a conveying-away unit.

The revolving device can be designed for example as a rotation body with a rotation axis. The closed conveying path of the receiving units for example runs along a movement path, particularly a circular path.

The delivery zone, i.e., that zone, in which the product units in the receiving units are in the region of influence of the support bodies, is preferably arranged in the lower half of the path course.

The receiving units for example can be designed as compartments, pockets or channels. The receiving units for example can include a base which forms an abutment for the connection edge of the introduced product unit or an insertion limitation for the product unit.

The receiving units can be pivotably mounted with respect to the revolving device via a pivot. Thus for example the receiving units are pivoted in the region of the delivery zone or to the delivery zone, in a manner such that the opening of the receiving unit, considered in the direction of gravity, comes to lie below the base of the receiving unit. A loosing or escape force effecting or encouraging a sliding of the product unit out of the receiving unit and being produced by gravity and, as the case may be, also by the centrifugal force of the rotating revolving device, acts on account of this.

The receiving units for example can be moved into the delivery zone for example in a manner such that the opening-side product region, in the conveying direction, i.e., in the rotation direction of the revolving device, is trailing with respect to the product region facing the base of the receiving unit.

The device can be an insertion device. Thus, the insertion device along the revolving device can include a product feed device as well as a supplement feed device. Moreover, devices for opening the product units can be provided between the product feed device as well as the supplement feed device.

Moreover, the device can also include elements for separating the product parts of a product with a connection edge of the type described and claimed above.

The support bodies can be arranged behind one another and for example distanced to one another, on a circulating conveying device, such as conveying chain or conveyor belt.

The circulating mechanism at the entry of the delivery zone can form a first deflection, in which the support bodies are pivoted over an arched path, particularly over a circularly arched path, out of the return section into a product delivery section in the delivery zone.

The product unit which is conveyed by the receiving unit into the delivery zone is supported with its opening-side product region on the rest surface of a support body entering into the delivery section.

The product unit on entry into the delivery zone, for example on account of a loosing force acting on this can partly slide out of the receiving unit, wherein the product unit with its opening-side product region is deposited onto the rest surface of the support body.

The support bodies or a component of the circulating mechanism can form an abutment for the product units, which prevents the product units sliding out of receiving unit too far or completely, at the beginning of the delivery zone.

The clamping element of a subsequent support body which is moved along an arched deflection into the product delivery section is now pivoted over the rest surface of the support body running in front and thus clamps the product unit on the rest surface. The pivot movement of the clamping element relative to the support body running in front is caused by the arched movement course of the support body in the deflection.

The clamping of the mentioned product region counteracts the loosing force, so that the product unit does not slide out of the receiving unit in an uncontrolled manner.

The support bodies can move more slowly, i.e., with a lower speed, along the product delivery section than the receiving units, in a manner such that the receiving units are pulled away from the product units which are led by the support bodies or accompanied by these. The product units in this manner slide out of the receiving units in a controlled manner. One can also speak of a passive pulling of the product units out of the receiving units.

In this context, the fact that the product units are not pulled out of the receiving units, but rather the receiving units are pulled away from the support product units is important.

The support bodies move along the product delivery section, particularly in the same movement direction as the receiving units.

The circulating mechanism moreover at the exit of the delivery zone can form a second deflection, in which the support bodies are moved over an arched path, particularly a circular arc path, out of the delivery zone or out of the product delivery section into the return section. With this procedure, the rest surface of the support body running in front and the clamping body of the support body running behind which is subsequent support body, move apart. The clamping of the opening-side product region is released by way of this and the product unit concerned can be completely transferred to a belt conveyor or to another conveying device of the conveying-away unit.

The first deflection is preferably arranged above the second deflection in the gravity direction. The two deflections are preferably laterally offset with respect to a horizontal.

The deflection can be effected by a deflection wheel, around which the conveying device with the support bodies fastened thereon is guided.

The circulating mechanism between the two deflections forms the product delivery section, along which the support bodies are moved through the delivery zone. The product delivery section can be designed in a straight-lined manner or essentially in a straight line. The product delivery section can have a drop in the conveying direction. This means that the support bodies are conveyed along a gradient or slope in the product delivery section.

The clamping element on the support body can be designed in a strip-like manner. The clamping element can be spring-elastic and for example consist of spring steel. The clamping element extends in the product delivery section in the conveying direction, preferably over the rest surface of the support body running in front.

The support bodies can be designed and arranged relative to one another such that the clamping element in the product delivery section, if no product is delivered, bears on the rest surface or forms a gap with this, the gap being smaller that the product region to be clamped, of the product unit to be delivered.

The clamping element moreover, particularly at the end of the delivery zone, can form a rest surface for the subsequent product unit, if this is released from the clamping.

The conveying-away unit can include a conveyor belt, on which the product units which have been completely delivered from the receiving units and are released from the clamping are conveyed away individually or in an imbricate stream or flow.

A cycled delivery to the conveying-away device is possible by way of the controlled release of the product units from the receiving units. This permits a cycle-controlled further processing of the product units.

BRIEF DESCRIPTION OF THE DRAWINGS

Subject-matters of the invention are hereinafter explained in more detail in each case by way of one embodiment example which is represented in the accompanying drawings, wherein.

Basically, the same parts are provided with the same reference numerals in the figures.

DETAILED DESCRIPTION OF THE INVENTION

Figure 7:
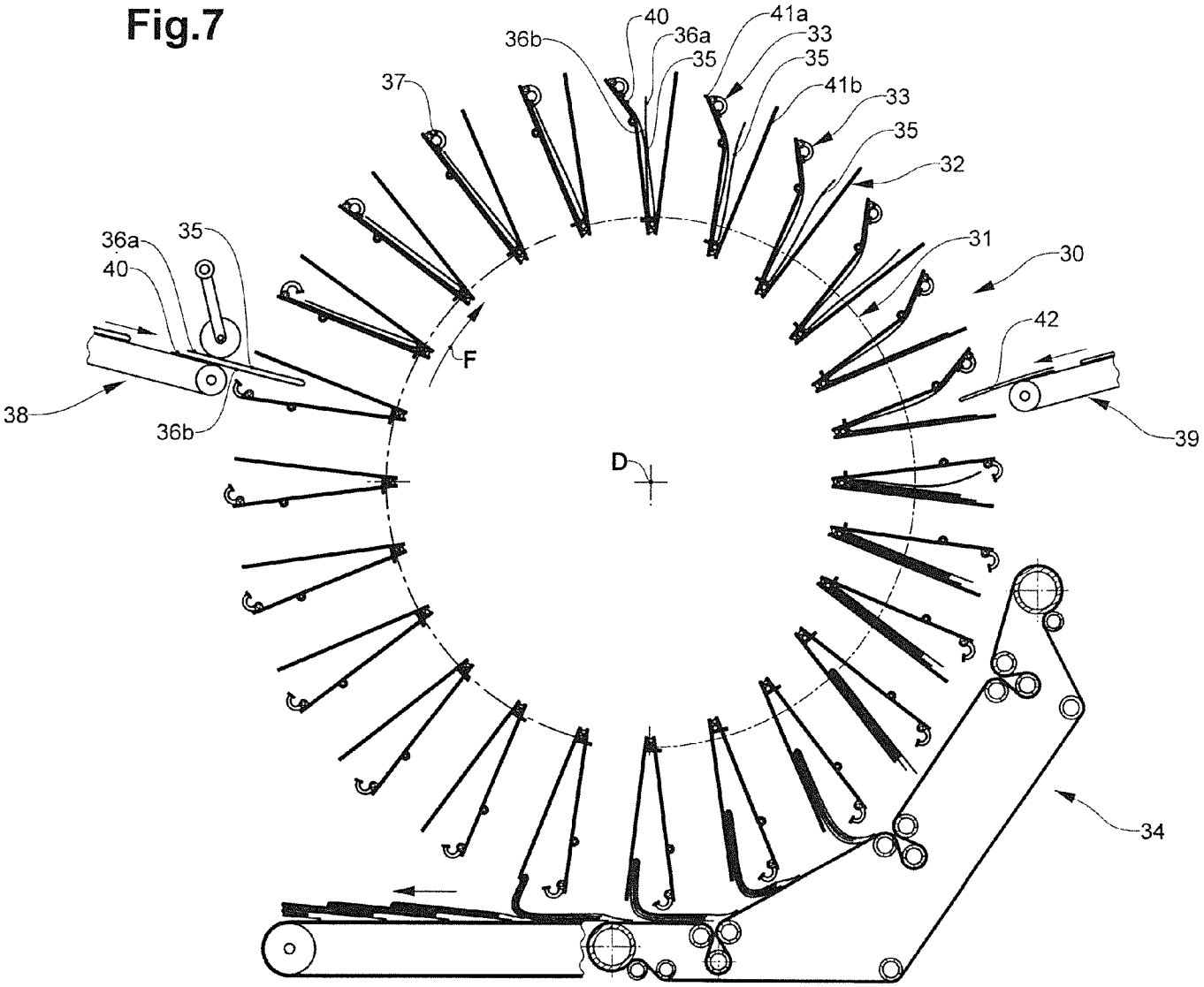
FIG. 7 is a schematic lateral view of an insertion device according to the state of the art.

FIGS. 1*a* to 6*e* illustrate a pocket 2 for receiving a folded printed product 5, as can be applied for example in an insertion device 1 according to FIG. 7.

The pocket 2 includes a wall 11*a* which leads in the conveying direction F, and a trailing wall 11*b*. The pocket 2 moreover includes a base 12 which can be adjusted with respect to the two walls 11*a*, 11*b*. The incorporation depth can be changed and adapted to different product formats by way of the adjustment of the base 12. This is effected via an adjustment device 7. The adjustment device 7 here is based on a trailing pocket wall 11*b* which is designed of two-parts. The baseward wall part, in which the pocket base is arranged, is fastened via an elongate hole guide on the second, opening-side wall part. The baseward wall part and with this, the pocket base, via the elongate hole guide is displaceable with respect to the opening-side wall part, to the pocket opening or away from this, so that the incorporation depth can be set.

The trailing pocket wall 11*b* moreover in the opening-side region includes adjustment devices 9 for adjusting lateral guide plates 29*a*, 29*b* which can be adapted to the width of the product 5. An elongate hole, in which a fastening device, e.g., a crew connection, which is connected to the guide plate, can be displaced and locked, is provided for creating the adjustability.

The pocket 2 can moreover be pivotably mounted in the device about a pivot axis 28.

The pocket 2 includes a clip device 3 each with two clip limbs 13*a*, 13*b* which are arranged next to one another and are distanced to one another, and are for firmly clamping the trailing product part 6*b* on the trailing wall 11*b*.

The two clip limbs 13*a*, 13*b* are arranged on a rotation rod 14. The rotation rod 14 and thus the clip limbs 13*a*, 13*b* which are fastened thereon are held in an open position (see FIGS. 1*a* and 1*b*) by the restoring force of restoring springs 15. The restoring springs 15 are designed as torsion springs and are arranged on the rotation rod 14.

The rotation rod 14 is actively connected to a stationary guide mechanism 14. For this, the rotation rod 14 is coupled onto a first guide element which includes a first cam roller. 16. The first cam roller 16 is led in the stationary guide mechanism 24 (see also FIGS. 6*a*-6*e*).

A change of the position of the first cam roller 16 with respect to the pocket 2 by way of the guide mechanism 24 causes a torque which counteracts the restoring force and which has the effect that the rotation rod 14 rotates opposite to the restoring force. The clips 13*a*, 13*b* are rotated to the trailing pocket wall 11 into a clamping position (see FIGS. 2*a* and 2*b*) by way of this.

The pocket 2 moreover includes a first friction element 4*a* which is fixed relative to the pocket 2 and which is arranged on the trailing pocket wall 11*b*. The first friction element 4*a* forms a first contact surface 17*a* of rubber.

The pocket 2 moreover includes a second friction element 4*b* which is movable relative to the pocket 2 and to the first friction element 4*a* and which forms a second contact surface 17*b* of rubber.

The pocket 2 moreover includes a pivot element 18 with a first pivot arm 53 and with a second pivot arm 54. The pivot element is mounted on a guide pivot 19, on the connection section between the two pivot arms 53, 54. The pivot element 18 is pivotably, i.e., rotatably, as well as axially displaceably mounted with respect to the guide pivot 19.

A pressing device 8 is arranged on the first pivot arm 53, at a radial distance to the guide pivot 19. The second friction element 4*b* is arranged on the pressing device 8. Moreover, a restoring spring 20 in the design of a compression spring is arranged on the guide pivot 10. A holding element 21 is arranged on the second pivot arm 54, at a radial distance to the guide pivot 19.

The pocket 2 moreover includes a pull element 50, e.g., a pull cable which with one end is fastened on the rear side of the pocket (see FIG. 5) via a restoring spring 51 designed as a tension spring. The pull element 50 at its other end is connected to the pivot arm 55 of a cam device comprising a second cam roller 22.

Moreover, the pull element 50 is connected between its two ends to the holding element 21. The pivot element 18 is thus coupled via the holding element 21, the pull element 50 and the pivot arm 55 to the second cam roller 22.

The associated operating method for separating two product parts 6*a*, 6*b* of a printed product 5 is described in more detail hereinafter. It is particularly the FIGS. 6*a* to 6*e* which are referred to with regard to this.

Figures 1A, 1B:
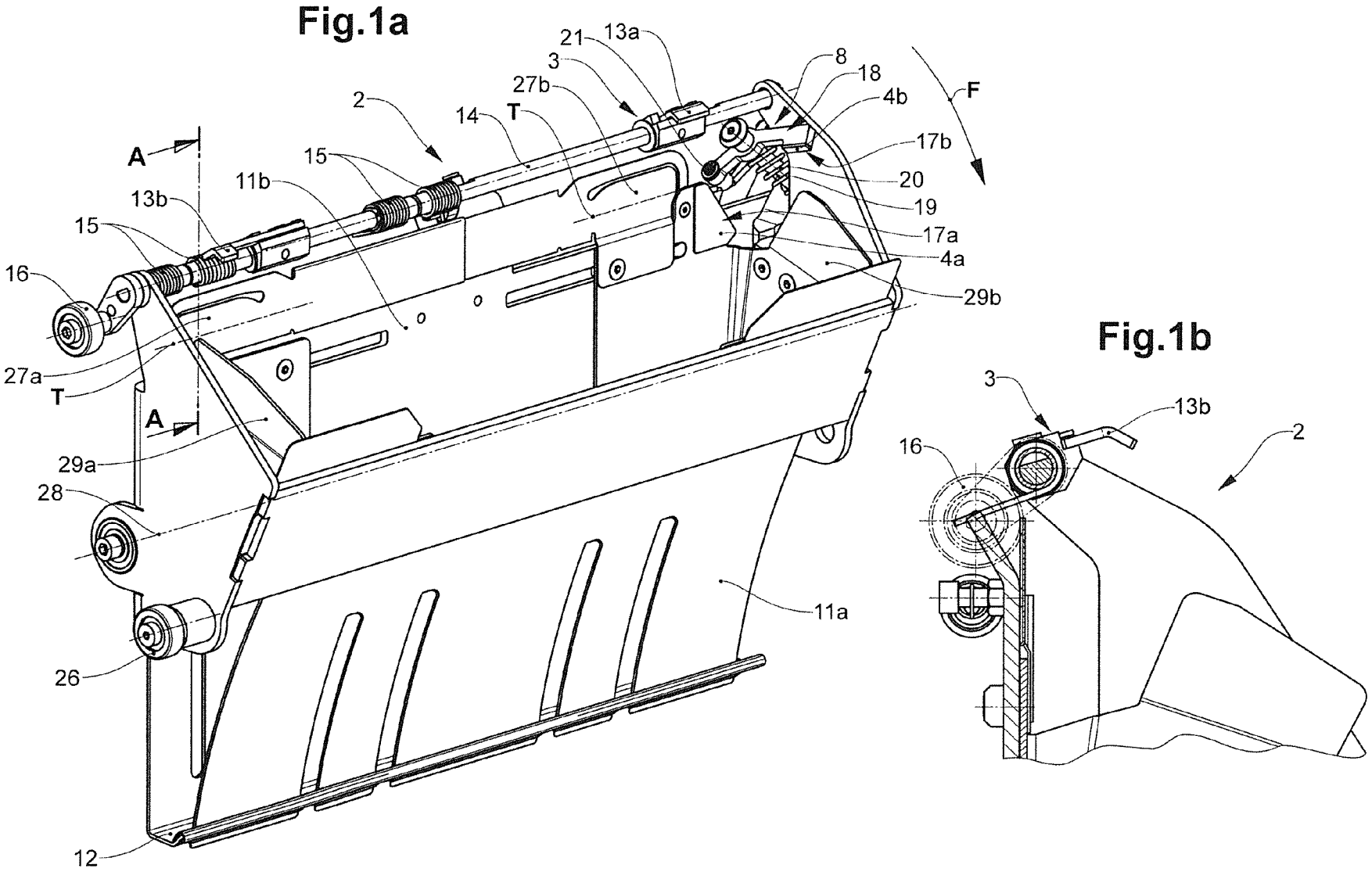
FIG. 1*a* is a perspective view of a pocket for receiving a folded printed product with an open clip.
FIG. 1*b* illustrates a section through a detail of the pocket according to FIG. 1*a* along the line A-A.
Figures 2A, 2B:
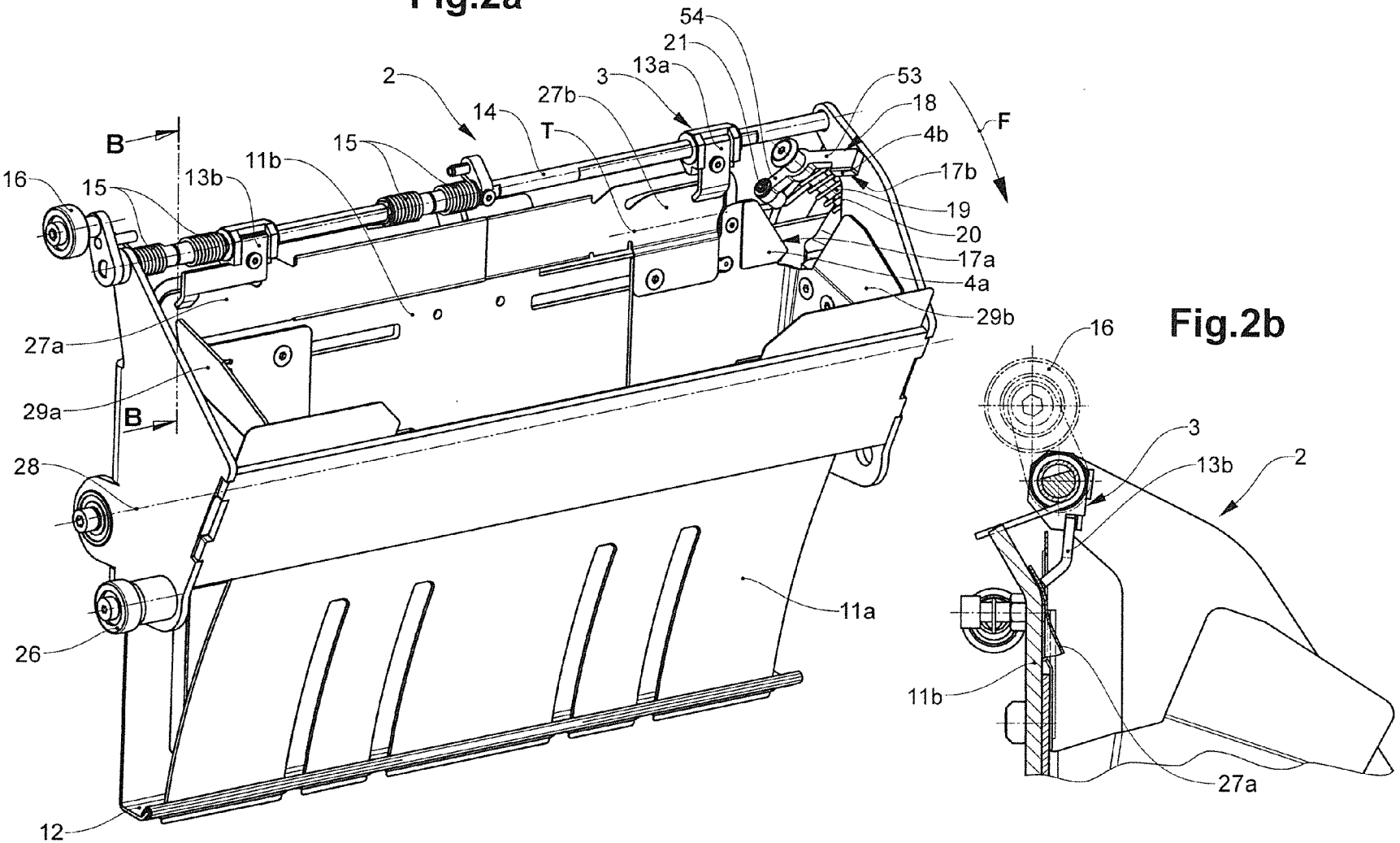
FIG. 2*a* is a perspective view of the pocket with a closed clip.
FIG. 2*b* illustrates a section through a detail of the pocket according to FIG. 2*a*, along the line B-B.
Figure 3:
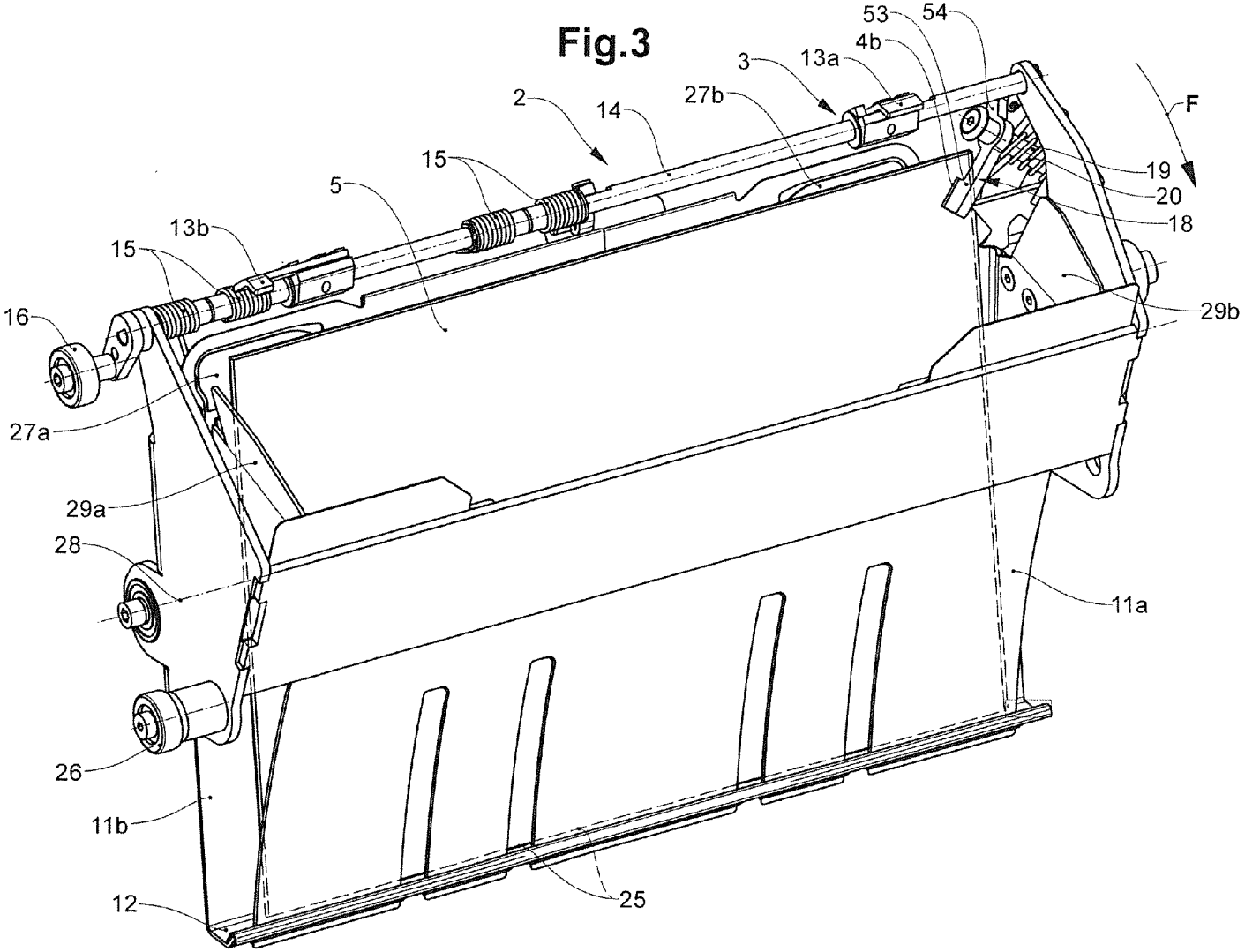
FIG. 3 is a perspective view of the pocket with an open clip, containing a product.
Figure 4:
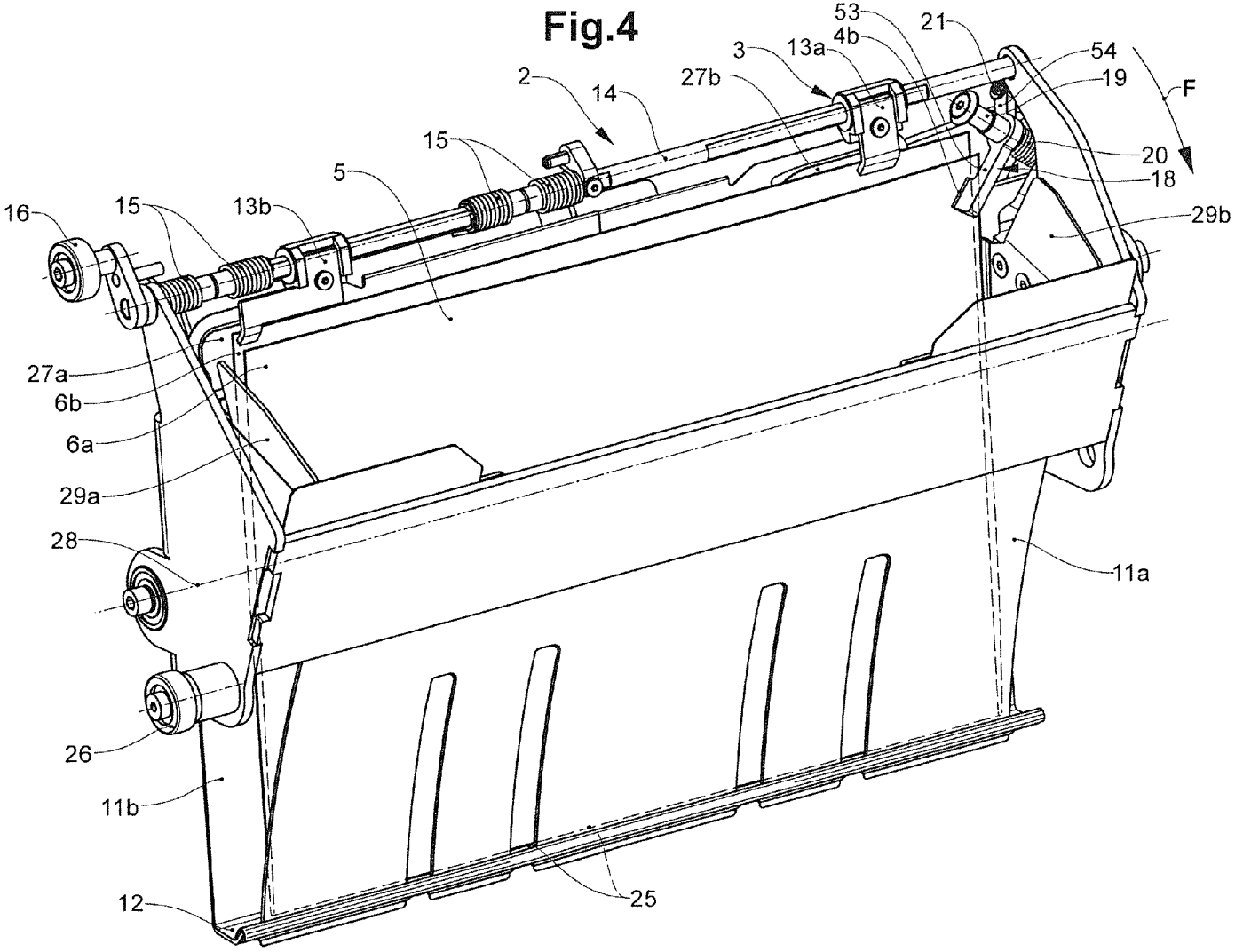
FIG. 4 is a perspective view of the pocket with a closed clip, containing a product.
Figure 5:
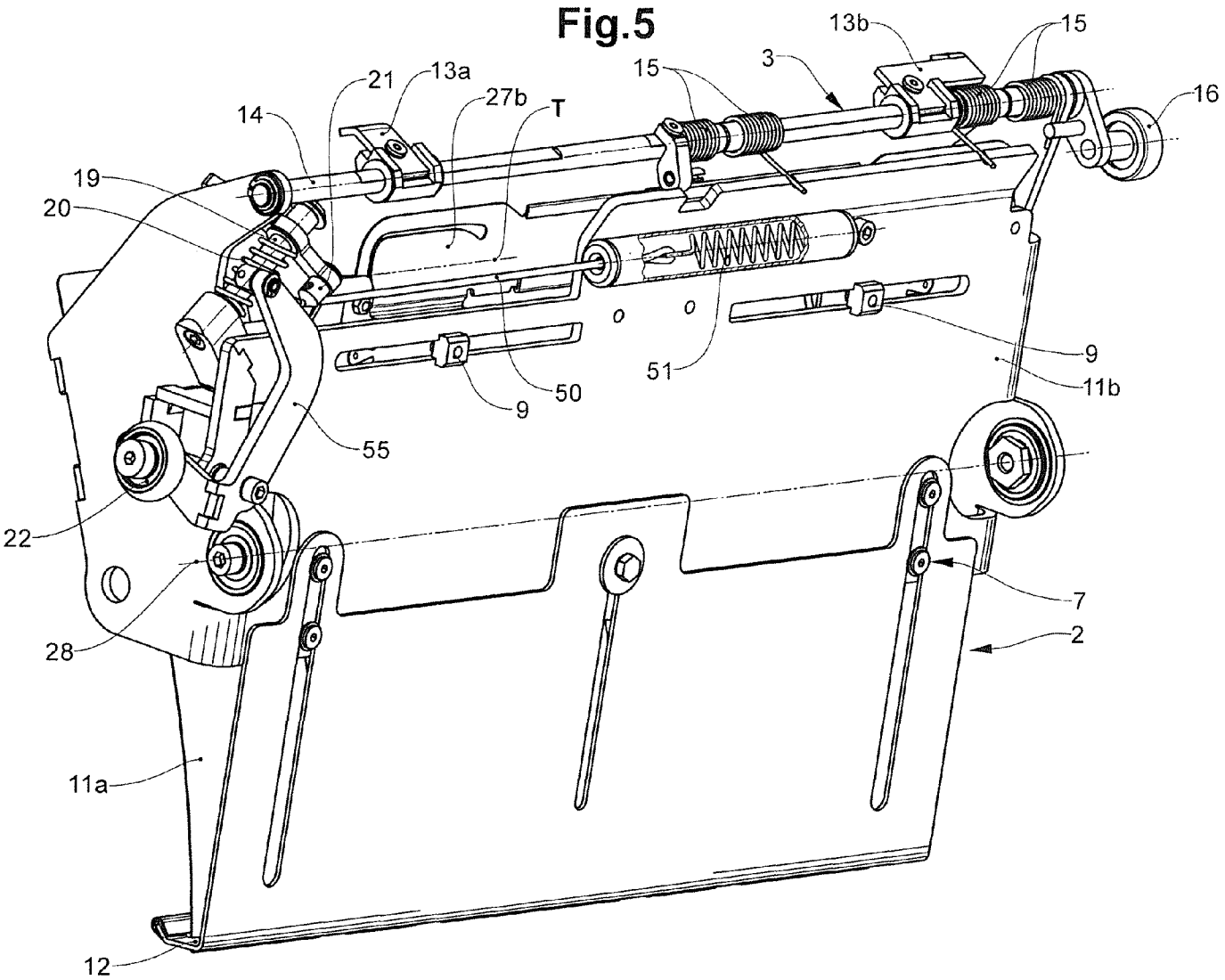
FIG. 5 is a perspective view of the pocket from the rear.
Figure 6A:
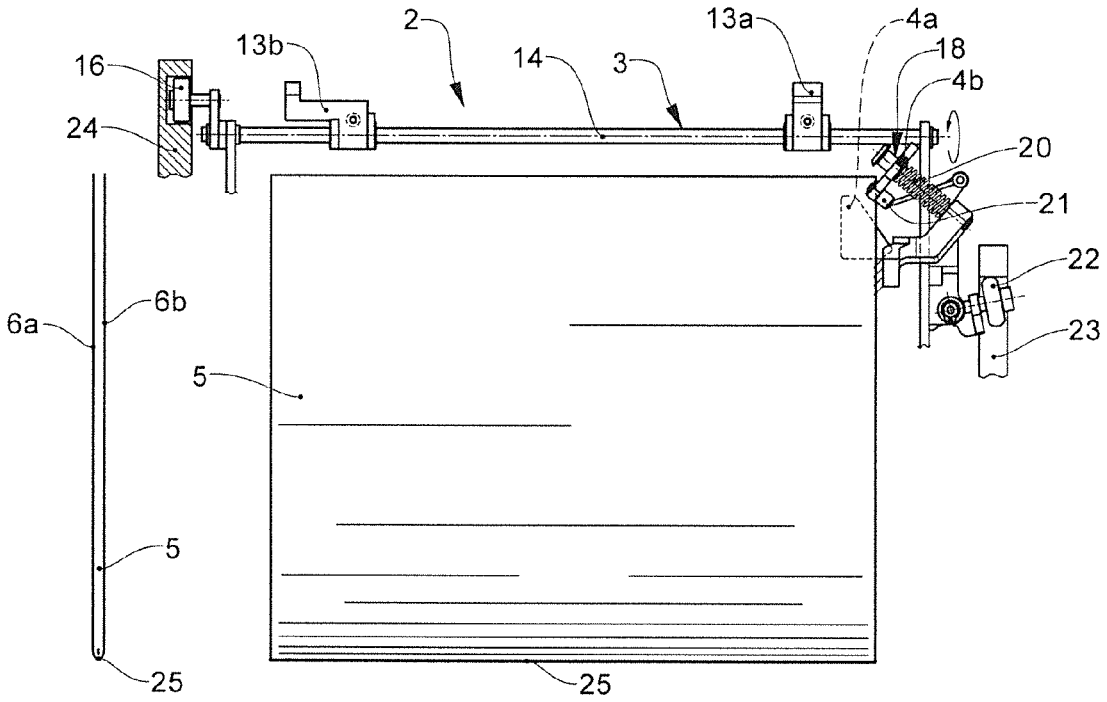
FIGS. 6*a*-6*e* are front views of a detail of the pocket in different operational positions.
Figure 6B:
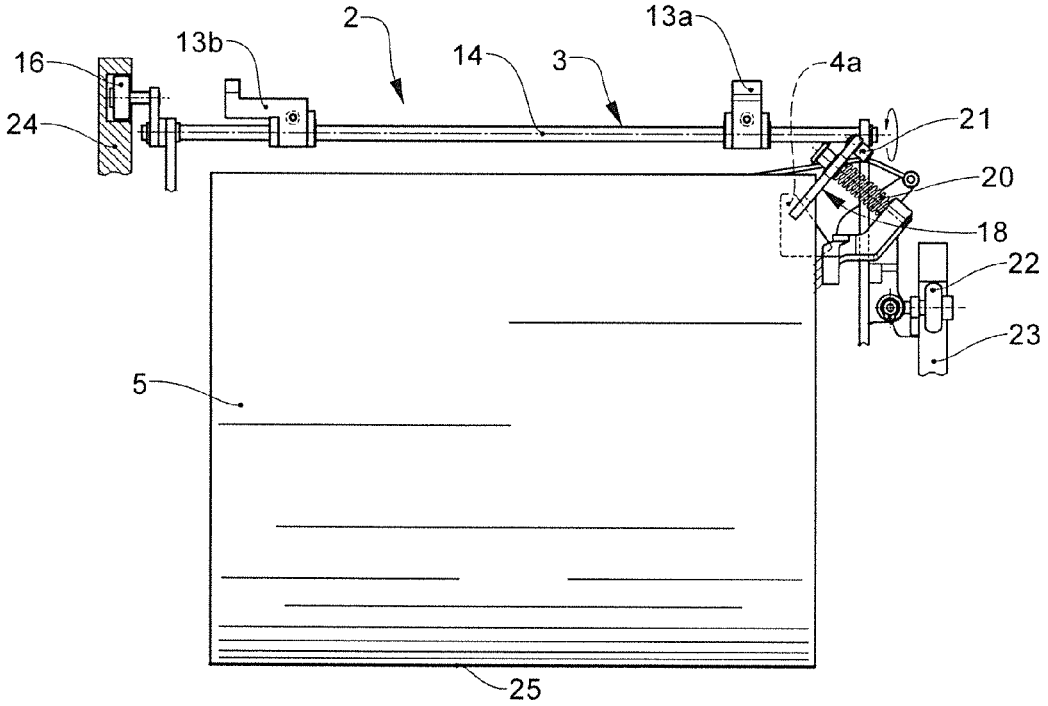
Figure 6C:
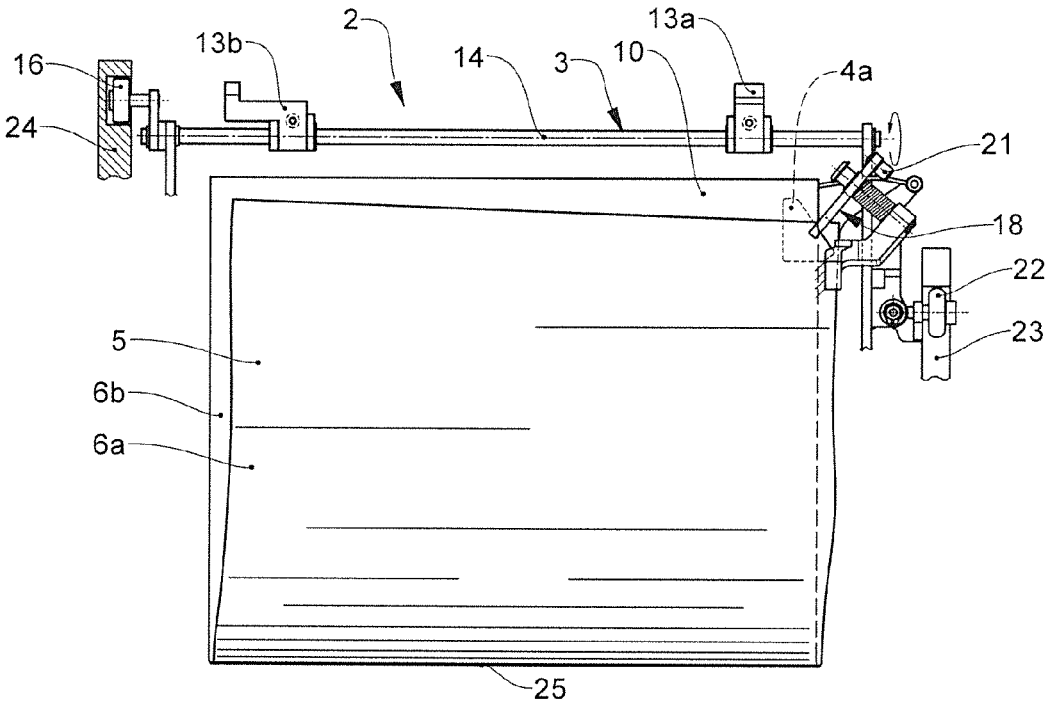
Figure 6D:
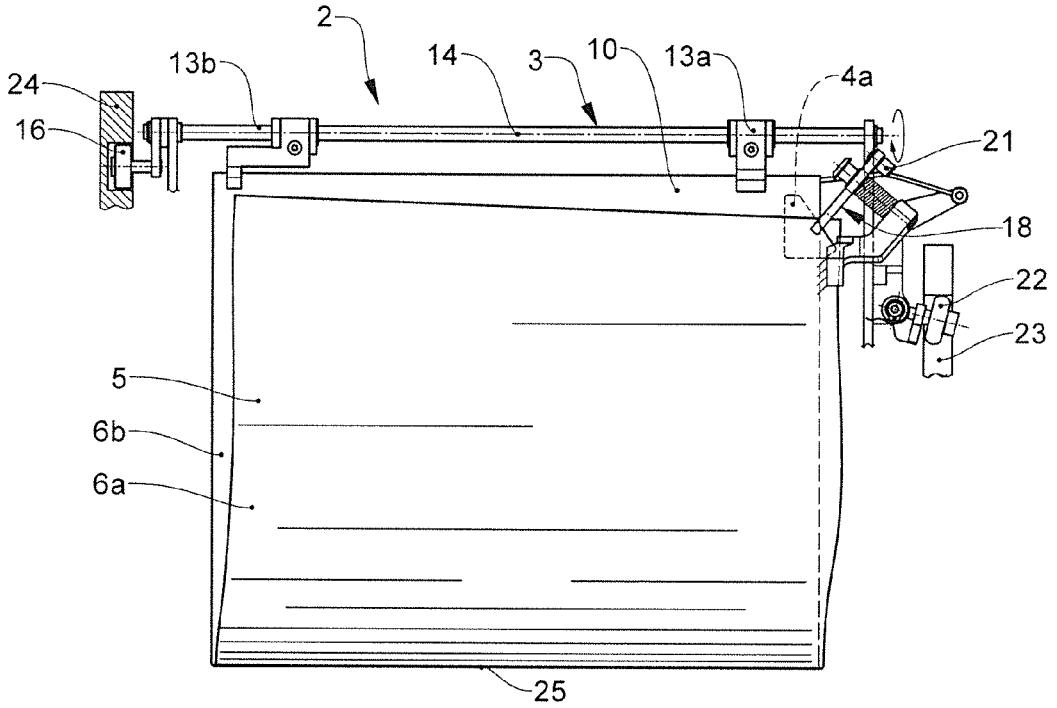
Figure 6E:
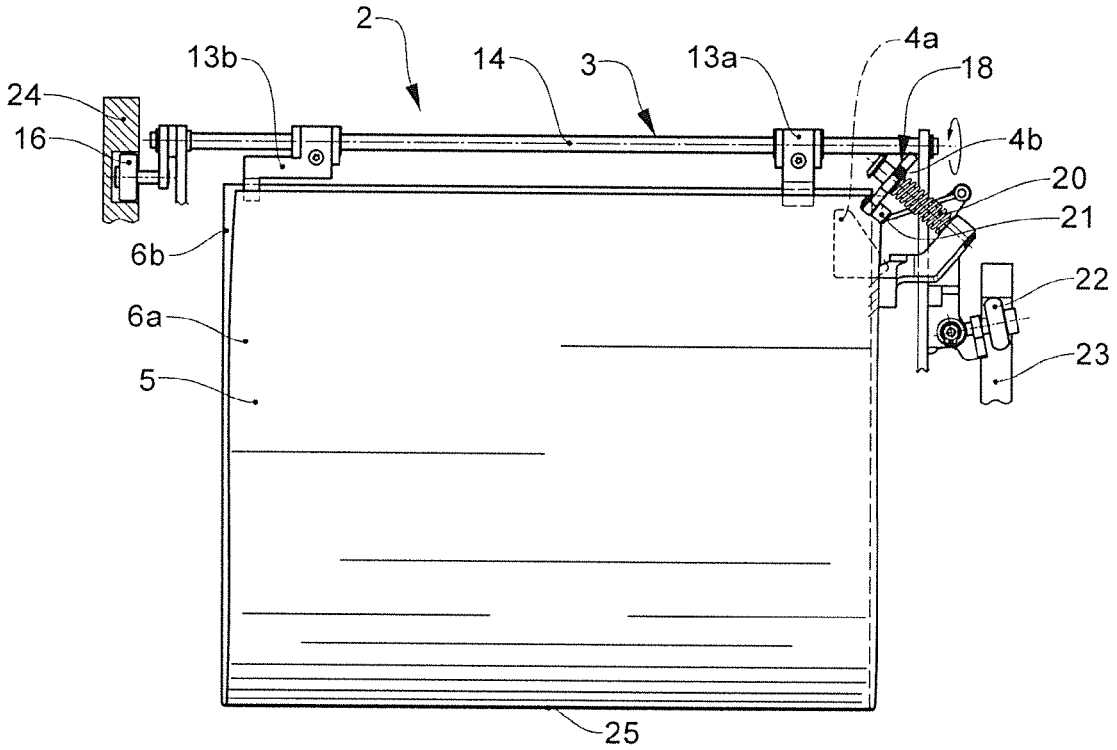

According to FIG. 3, the folded printed product 5 is introduced into the pocket 2, wherein the printed product 5 with its fold edge 25 in front is led to the pocket base 12.

The clip limbs 13*a*, 13*b* of the clip device 3 are held in the open position by way of the restoring force of the restoring springs 15.

The pivot arm 18 with the second friction element 4*b* is held in an open position by way of the pull force of the pull element 50. This means that the pivot arm 18 is pivoted outwards with the second friction element 4*b*. The pull force on the pivot arm 18 is produced by the restoring force of the tension spring 51 which acts on the pull element 50.

The pivot arm 18 with the second friction element 4*b* is then pivoted to the printed product 5 for separating the product parts 6*a*, 6*b*. This is effected by way of a positional change of the second cam roller 22 relative to the pocket 2. The positional change is caused by way of the guide mechanism (not shown). The position change of the cam roller 22 causes a pivot movement of the associated pivot arm 55, on which the pull element 50 is fastened with the one end.

A pull force is exerted onto the pull element 50 due to the movement of the pivot arm 55, and this force counteracts the restoring force of the tension spring 51. The holding element 21 is set into motion by way of the pull movement of the pull element 50, by which means the pivot element 18 carries out a pivot movement. The first pivot arm 53 with the second friction element 4*b* is pivoted to the printed product 5 by way of the pivot movement of the pivot element 18.

The second friction element 4*b* then with its contact surface 17*b* bears on the leading product part 6*a*. With this procedure, the printed product 5 or the two product parts 6*a*, 6*b* is/are clamped in between the first and the second friction element 4*a*, 4*b*. Accordingly, the trailing product part 6*b* is led onto the contact surface 17*a* of the first friction element 4*a*. In this operational position, the two friction elements 4*a*, 4*b* at least partly lie opposite one another.

The pivot movement of the pivot arm 55 is continued via the cam-guided movement of the second cam roller 22, for moving the two friction elements 4*a*, 4*b* relative to one another. The pull force which continues to be exerted on the pull element 50 in this manner then effects an axial displacement of the pivot element 18 along the guide pivot 19.

The axial movement causes a compression loading of the restoring spring 20, so that an axial restoring force subjected to compression is exerted on the pivot element 18, which however is compensated due to the pull force on the pull element 50 which is generated by the second cam roller 22 on account of its position in the cam guide.

The second friction element 4*b* is laterally displaced with respect to the fixed first friction element 4*a* by way of the axial movement of the pivot element 18 along the guide pivot 19.

The lateral displacement of the second friction element 4*b* effects a corresponding lateral displacement of the leading product part 6*a* with respect to the trailing product part 6*b*, since the friction in each case between the friction element 4*a*, 4*b* and the product part 6*a*, 6*b* is greater than the friction between the two product parts 6*a*, 6*b*.

With this procedure, the free edge of the leading product part 6*a* displaces with respect to the free edge of the trailing product part 6*b*, wherein the trailing product part 6*b* forms an exposed region 10 compared to the leading product part 6*a*.

A position change of the first cam roller 16 with respect to the pocket 2 and which is caused by the guide mechanism then causes a rotation movement of the rotation rod 14. With this procedure, the clip limbs 13*a*, 13*b* are pivoted counter to the restoring force of the restoring springs 15, to the trailing product part 6*b*. The clip limbs 13*a*, 13*b* are led up to the trailing product part 6*b* and press these onto the trailing pocket wall 11*b* in a clamping manner in the exposed region 10.

The pull force which exerted onto the pull element 50 by way of the second cam roller 22 via the associated pivot arm 55 is relieved again due to the renewed positional change of the second cam roller 22 relative to the pocket 2. The positional change of the second cam roller 22 is likewise activated by the guide mechanism.

The pull element 50 is refracted again due to the pull force of the restoring spring 51, and this also effects a displacement of the holding element 21. The pivot element 18 then together with the second friction element 4*b* is then axially pushed back into its axial initial position by way of the restoring force of the restoring spring 20.

The pull element 50 is then refracted further by way of the restoring spring 51. Thereby, the pivot element 19 which is already in its axial initial position and with this the first pivot arm 53 with the first friction element 4*a* is pivoted back into its initial position.

The clamping of the product parts 6*a*, 6*b* by the friction elements 4*a*, 4*b* is lifted by way of the pivoting of the first pivot arm 18 back into its initial position. The leading product part 6*a* again assumes its original shape due to the intrinsic stress or tension. The exposed region 10 disappears with this procedure, so that the clip limbs 13*a*, 13*b* which firmly clamp the trailing product part 6*b* come to lie between the product parts. The clip limbs 13*a*, 13*b* now between the two product parts 6*a*, 6*b* form a gap and prevent the two product parts 6*a*, 6*b* from bearing on one another again.

Due to the pivot movement of the pocket 2 which for example is effected via a third guide element, the pocket is pivoted in a manner such that the leading product part 6*a* is moved on account of gravity towards the leading pocket wall 11, by which means the printed product 5 is opened. The third guide element for this includes a third cam roller 26 which is led in a guide (not shown).

The pocket 2 according to FIGS. 1*a* to 4 moreover includes an integrated opening aid which renders the opening of the printed product 5 by way of pivoting the pocket 2 superfluous or at least supports this.

The opening aid includes two deformation elements 27*a*, 27*b* of spring steel, which are integrated into the trailing pocket wall 11*b*. The two deformation elements 27*a*, 27*b* include a contact surface which is surrounded by a free edge and which is connected via a connection section to the trailing pocket wall 11*a*. The connection section with respect to the contact surface forms a narrowing. The torsion element 27*a*, 27*b* is designed and integrated in the trailing pocket wall 11*b*, in a manner such that the contact surface can be twisted with respect to the pocket wall 11*b* by way of the pressing of the clips via the connection section, wherein the torsion axis runs parallel to the pivot axis of the clip limbs 13*a*, 13*b*.

If then the trailing product part 6*b* is clamped onto the trailing pocket wall 11*b* by way of pivoting the clip limbs 13*a*, 13*b*, then the clip limbs 13*a*, 13*b* likewise press onto the contact surface of the deformation elements 27*a*, 27*b*. Since the contact surface lies outside the torsion axis T, the push force exerted by the clips 13*a*, 13*b* onto the contact surface causes a twisting of the deformation element 27*a*, 27*b*. With this procedure, the push-loaded surface region of the contact surface moves back, whereas that surface region of the contact surface which lies on the other side of the torsion axis T is moved forwards in the direction of the bearing product part 11*b*. With this procedure, the surface region of the deformation element 27*a*, 27*b* which comes to the front shapes an arching in the trailing product part 6*b*. This arching in turn acts on the leading product part 6*a* and pushes this away in the direction of the leading pocket wall 11*a*. The product parts 6*a*, 6*b* are separated which means the product 5 is opened in this manner.

The opening aid described above can be considered as an independent aspect of the invention.

FIG. 7 illustrates an insertion device 30 with a plurality of pockets 32 arranged around a revolving device, according to the state of the art. The revolving device 31 is a rotation body rotating about rotation axis D. The pockets 32 include a leading pocket wall 41*a*, a trailing pocket wall 41*b* as well as a clip device 33 with clip limbs 37 for firmly clamping the trailing product part 36*b* of a folded printed product 35 on the trailing pocket wall 44*b*. The trailing product part 36*b* is hereby firmly clamped on the pocket wall 44*b* via its overlap 40.

The printed products 35 are fed to the pockets 32 via a product feed device 38, past which the pockets 32 are moved. Supplements 42 are inserted into the printed products 35 which in the meanwhile are opened, at a supplement feed device 93 which is subsequent in the conveying direction F, i.e., in the rotation direction. The printed products 35 are opened between the product feed device 38 and the supplement feed device 39.

The printed products 35 which are closed again after inserting the supplements 42, are subsequently delivered to a product delivery device 34 for further conveying, the product delivery device 34 being subsequent in the conveying direction F, i.e., in the rotation direction.

The insertion device 30 can then be equipped with the receiving units according to the invention, in particular with the pockets 2 according to FIGS. 1*a* to 5, as well as associated stationary guide mechanisms. This permits the opening of fed printed products 5 without an overlap 40.

Figure 8:
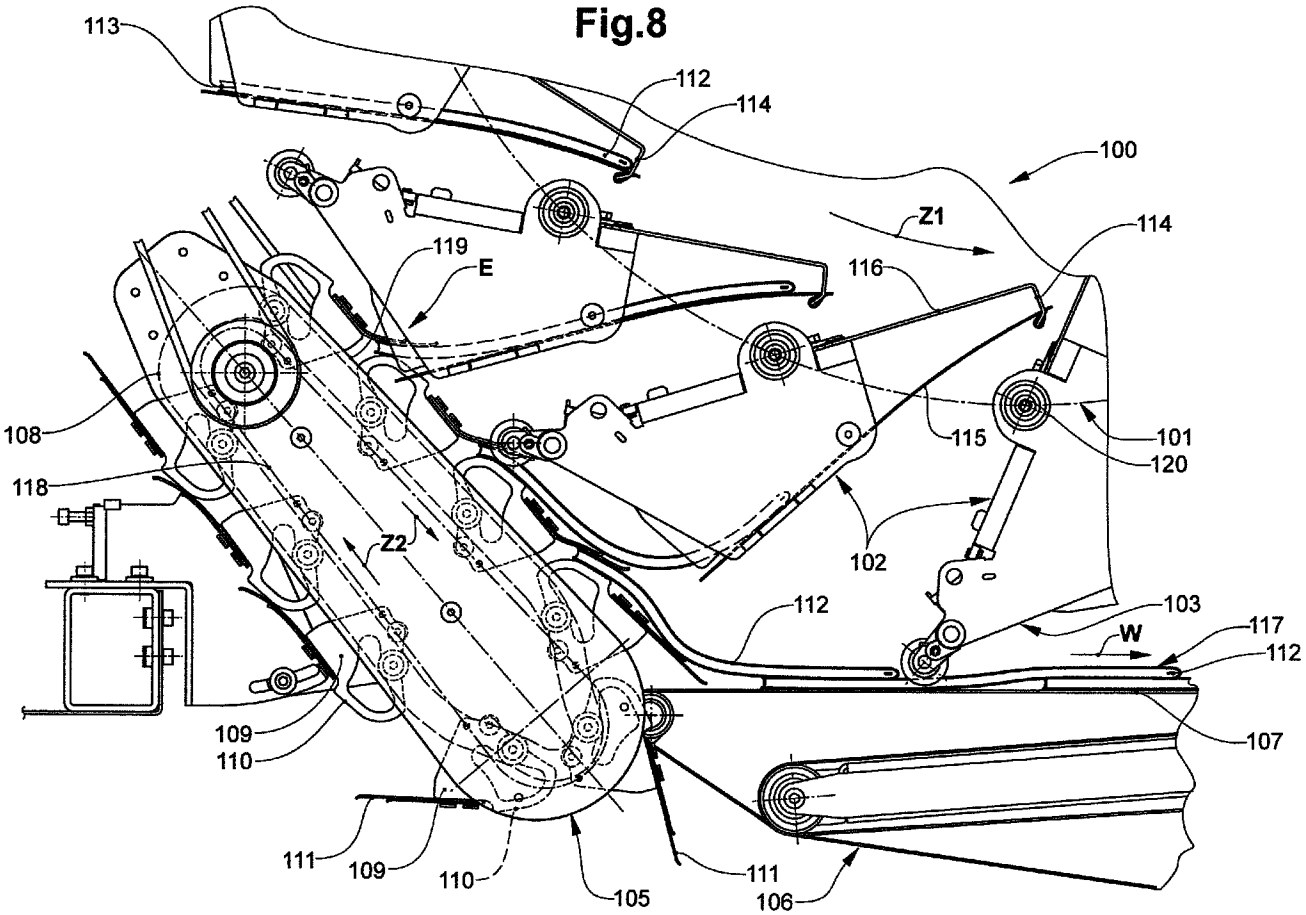
FIG. 8 is a schematic lateral view of a device with a rotating device and with a conveying-away device, according to the further aspect of the invention.
Figure 9:
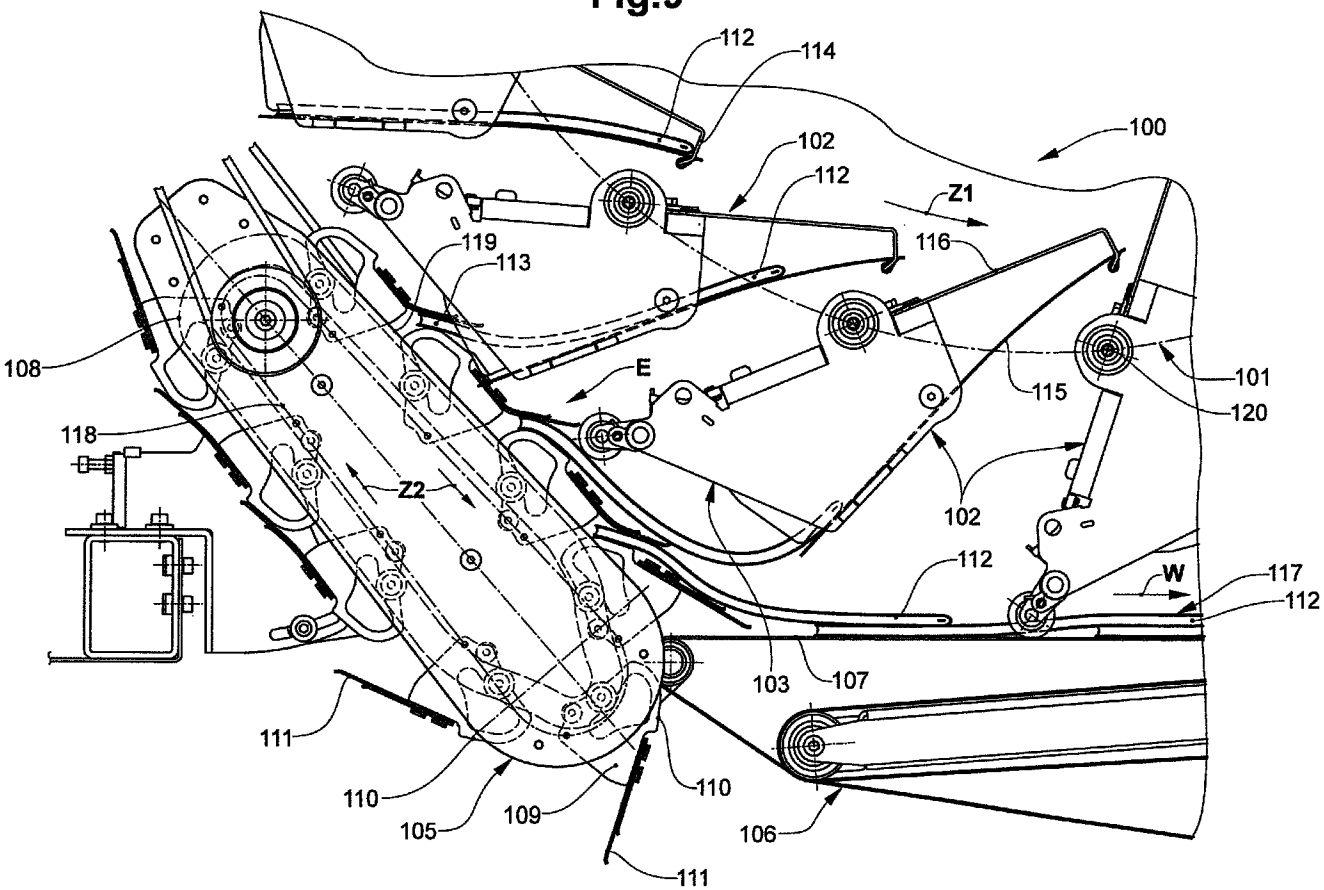
FIG. 9 is an enlarged detail of the device according to FIG. 8, from the region of the circulating mechanism.

FIGS. 8 and 9 illustrate a device 100 for delivering flat product units 112 in further accordance with the invention. The device 100 includes a revolving device 112 with a plurality of pockets 102 which are arranged along its periphery and are with radially outwardly facing pocket openings 103. The revolving device 101 is designed as a rotation body which is rotatable about a rotation axis D in the rotation direction Z1. The pockets 102 describe a circular movement path.

Moreover, the device 10 includes a conveying-away device 105 for the controlled delivery of the product units 112 out of the pockets 102 and for the transfer of the product units to a conveying-away unit 106.

The conveying-away device 105 includes a circulating mechanism 108 with a plurality of support bodies 109 which revolve along a closed circulating path in the movement direction Z2 on a conveying chain 118. The support bodies 109 in each case form a rest surface 110. Moreover, the support bodies 109 each include a strip-like clamping element 111 of spring steel. The clamping element 111 and the rest surface 110 are designed, and the support bodies 109 are arranged one after the other along the circulating path, in a manner such that the product unit 112 with its opening-side product region 113 is supported in the delivery zone E on the rest surface 110 and is firmly clamped by the clamping element 111 of the subsequent support body 109 on the rest surface 110.

The circulating mechanism 108 forms an upper and a lower deflection for the support bodies 109. The lower deflection is arranged horizontally offset to the upper deflection in the movement direction of the pockets 102, so that a straight-lined product delivery section arranged between the two deflections forms a slope in the movement direction Z2 of the support bodies 109.

The conveying-away device 105 moreover includes a conveying-away unit 106 which connects in the movement direction Z1 of the pockets 102 and is with a horizontally running conveyor belt 107.

The controlled delivery of a product unit 112 is effected in the subsequently described manner.

The product unit 112 is conveyed in the pocket 102 along its movement path into the delivery zone E of the conveying-away device 105. With this procedure, the pocket 102 is pivoted about the pivot axis 120 in a manner such that the pocket opening 103 comes to lie more deeply than the pocket base 114. A loosing force due to gravity acts on account of this and causes a partial sliding of the product unit 112 out of the pocket 102.

The opening-side product region 113 of the product unit 112 sliding out of the pocket 102, at the entry to the delivery zone E is supported on the rest surface 110 of a support body 109 which is moved via the upper deflection into the product delivery section. The circulating mechanism 108 forms an abutment edge 119 which prevents a complete sliding of the product unit 112 out of the pocket 102 at the beginning of the delivery zone E.

The clamping element 111 of a subsequent support body 109 which is moved along a circular-arc-shaped deflection out of the return section into the product delivery section is pivoted over the rest surface 110 of the support body 109 running in front and clamps the opening-side product region 113 on the rest surface 110.

The clamping of the mentioned product region 113 acts opposite to the loosing force, so that the product unit 112 cannot slide out of the pocket 102 in an uncontrolled manner, The support bodies 109 move along the product delivery section with a lower speed than the pockets 102. On account of this, the pockets 102 moving more quickly through the delivery zone E are pulled away from the product units 112. The product units 112 in this manner slide in a controlled manner out of the pockets 102.

The circulating mechanism 108 then at the exit of the delivery zone E, which means at the end of the product delivery section, forms a second deflection, in which the support bodies 109 are moved over a circular arc path out of the delivery zone E or out of the product delivery section into the return section.

With this procedure, the rest surface 110 of the support body 109 running in front, and the clamping element 111 of the subsequent support body 109 move apart. The clamping of the product region 113 is lifted by way of this and the product unit 112 concerned is transferred to a conveyor belt 107 of the conveying-away unit 106 which connects to the circulating mechanism 108, and is conveyed away horizontally in the conveying direction. An imbricate stream of product units is formed on the conveyor belt 107.

The clamping element 111 particularly at the end of the product delivery section also forms a rest surface or support surface for the subsequent product unit 112. With this, a disturbance-free delivery of the product unit 112 to the conveyor belt 107 is ensured.

The device and the associated method permit a controlled and supported delivery of the product units 112 out of the pockets 102. The product units 113 for this do not need to be actively pulled out of the pockets 102. Rather, the product units 112 held on the openings-side product region 113 slide out of the pockets in a controlled manner due to the pockets 102 which are moved more quickly compared to the held product unit 12.

Figure 10:
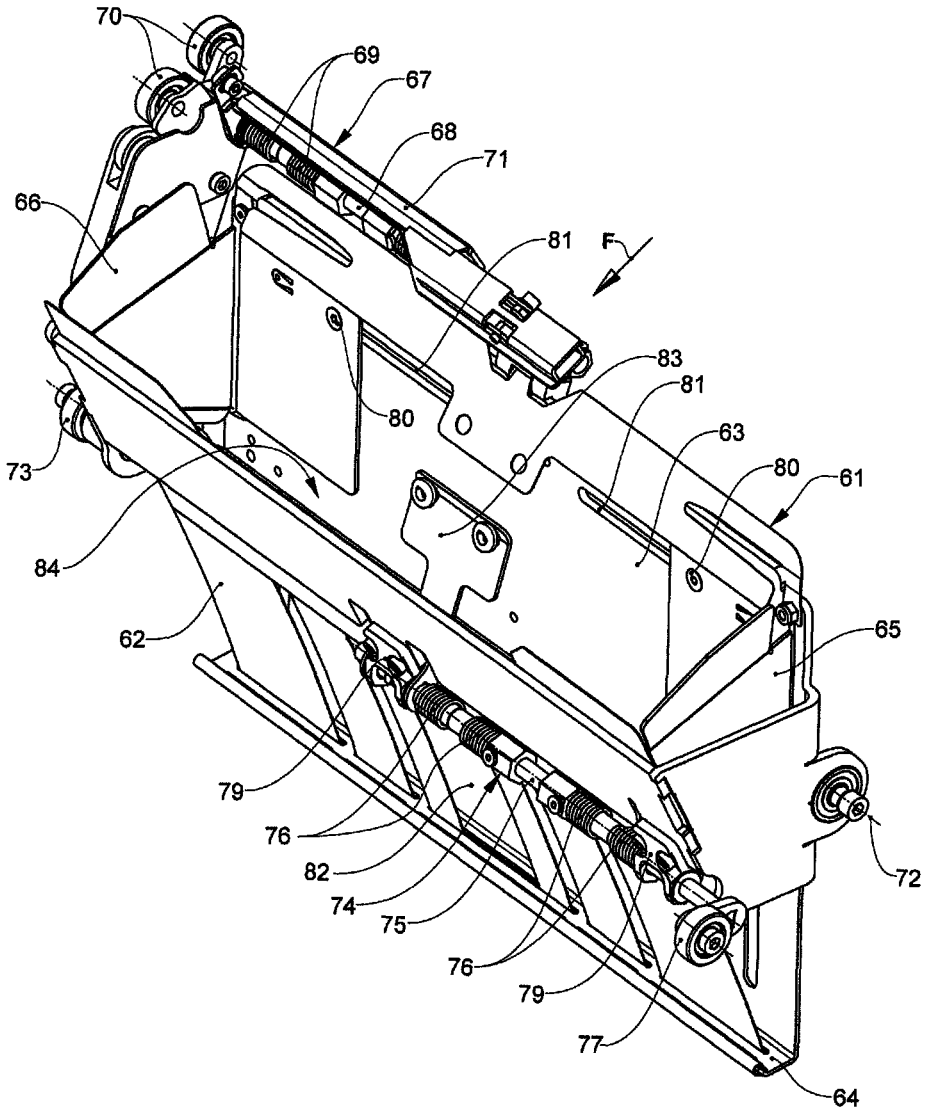
FIG. 10 is a perspective view of a receiving pocket for receiving a multi-part printed product according to a further embodiment variant.
Figure 11:
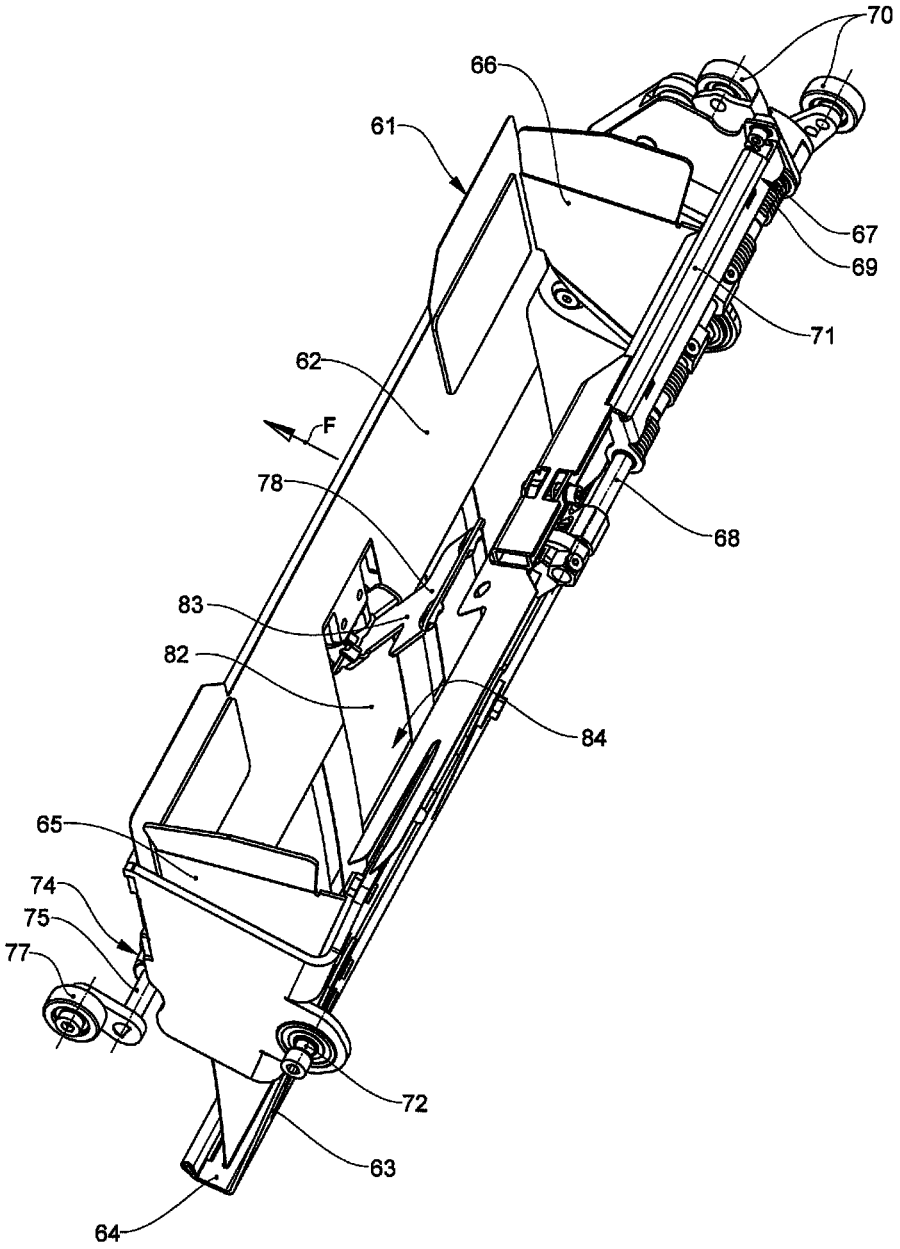
FIG. 11 is a further perspective view of the receiving pocket according to FIG. 10.

FIGS. 10 to 11 illustrate an embodiment of the receiving pocket 61 of an insertion device for receiving and for opening a multi-sheet printed product which is held at one side. The insertion device for example can be an insertion device of the type shown in FIG. 7.

The receiving pocket 61 includes a leading pocket wall 62 which is first in the conveying direction F, and a second, trailing pocket wall 63. The receiving pocket 61 moreover includes a pocket base 64. This can be adjusted with respect to the two pocket walls 62, 63. The incorporation depth can be changed and adapted to the different product formats by way of the adjustment of the pocket base 64. This for example can be effected via an adjustment device which is not described in more detail at this location, as is likewise described in the context of the receiving pocket according to FIG. 5.

The trailing pocket wall 63 in an opening-side region includes adjustment device for adjusting lateral guide plates 65, 66 which can be adapted to the width of the product. In each case an elongate hole 81 is provided, in which a fastening device 80, e.g., a screw connection, which is connected to the guide plate 65, 66, can be displaced and locked.

The receiving pocket 61 is moreover pivotably mounted about a pivot axis 72. The pivoting of the receiving pocket 61 about the pivot axis 72 is effected via the positional change of a cam roller 73 led in a stationary guide mechanism.

The receiving pocket 61 includes a clip device 67 with a clip 71 for firmly clamping an exposed region of the second, trailing product part of a printed product inserted into the receiving pocket 61, on the trailing pocket wall 63.

The exposed region for firmly clamping the trailing product part can for example be produced according to the device for separating two product parts of a multi-part product, the device being described by way of FIGS. 1*a* to 6*e*. Alternatively, the exposed region can also be formed by an overlap on the trailing product part.

The clip 71 is arranged on a rotation rod 68. The rotation rod 68 and thus the clip 71 fastened thereon is held in an open position (see FIG. 10) by way of the restoring force of restoring springs 69 (see FIG. 10). The restoring springs 69 are designed as torsion springs and are arranged on the rotation rod 68.

The rotation rod 68 is coupled onto a cam roller 70 which is actively connected to a stationary guide mechanism. The cam roller 70 is guided in the stationary guide (not shown). A change of the position of the cam roller 70 with respect to the receiving pocket 61 by the guide mechanism creates a torque counteracting the restoring force. This torque effects a rotation of the rotation rod 68 counter to the restoring force of the restoring springs. By way of this, the clip 71 is pivoted to the trailing pocket wall 63 into a clamping position. Thereby, the clip 71 is led up to an exposed section of the trailing product part and holds this on the trailing pocket wall 63 in a clamped manner.

The receiving pocket 61 now moreover includes a movement impulse transmission device 74 which is arranged on the leading pocket wall 62. This includes a rotation rod 75 which is rotatably mounted on the outer side of the leading pocket wall 62 via holders 79. A cam roller 77 is connected to the rotation rod 75 via a guide arm, laterally of the leading pocket wall. The cam roller 77 is guided in a stationary guide mechanism.

Moreover, an impulse element 78 is attached via a fastening on the rotation rod 75 in a rotationally fixed manner. The impulse element 78 is fastened in the region of a recess in the leading pocket wall 62, on the rotation rod 75. The impulse element 75 itself is arranged on the leading pocket wall, in the inside of the receiving pocket 61.

The impulse element 78 can now be pivoted via a rotation with the rotation rod 75, with a pivot section 83 to the first leading product part in the receiving pocket 61. The impulse element 78 can for example be of spring steel.

The movement impulse transmission device 74 moreover includes restoring springs 76 designed as torsion springs 76. The restoring springs 76 are arranged on the rotation rod 75. The restoring springs 76 ensure that the rotation rod 75 and thus the impulse element 78 attached on this, due to restoring force of the springs, are led from a pivot position, in which the pivot section 83 of the impulse element 78 is pivoted to the leading product part, back into an initial position, in which the pivot section 83 of the impulse element 78 bears on the leading pocket wall 62. The pivot section 83 thereby in the initial position bears on the inner side of the leading pocket wall 62 which faces the receiving compartment 84. The impulse element 78 can include damping elements such as elastomer buffers on the pivot section 83, and these damp the abutment of the pivot section 83 on the leading pocket wall 62.

The impulse element 78 is actuated by way of a positional change of the cam roller 77. The positional change of the cam roller 77 for example is caused by a guide mechanism. The positional change of the cam roller 77 creates a rotation movement of the rotation rod 75. In turn, the impulse element 78 with its pivot section 83 is again pivoted in the direction of the receiving compartment 84 to the leading product part, by way of the rotation of the rotation rod 75. The pivoted-out impulse element 78 now with its pivot section 83 hits the leading product part of a printed product which is introduced into the receiving pocket 61 and is held by the clip 71 on the trailing product part. Thereby, the impulse element 78 in a middle section of the leading product part transmits a movement impulse in the direction of the trailing pocket wall 63.

The positional change of the cam roller 77 and accordingly the rotation of the rotation rod 75 is effected in a comparatively rapid, in particular jerky movement, so that the impulse element 78 with its pivot section 83 exerts jerky or abrupt impulse onto the middle section of the leading product part. The middle section of the leading product part is now moved or catapulted by way of this jerky impulse in the direction of the trailing pocket wall 63. Due to the jerky movement of the middle section of the printed product to the trailing pocket wall 63 or to the trailing product part, an upper section of the leading product part which borders the upper free edge of the opening side, rushes in a counter movement to the leading pocket wall 62. The printed product is opened by way of this.

The mentioned counter movement particularly is effected by way of a wave-like movement of the leading product part which, activated by the above-described actuation of the impulse element 78, propagates from the middle section to the upper section of the leading product part. This wave movement finally leads to the upper section of the leading product part being removed from the trailing, clamped product part, and the printed product opening.

The jerky movement of the printed product which finally leads to the opening of this can be supported by an additional pivot movement of the receiving pocket 61 about the pivot 72.

The opening mechanism which is described above can be considered as being independent of the likewise shown adjustment mechanisms for the pocket base 64 or the lateral guide plates. The same also applies with respect to the pivot mechanism for pivoting the receiving pocket 61 as well with respect to the clip device 67.

The invention claimed is:

1. A device for separating product parts of a multi-part, flat product, comprising a receiving unit for receiving the product, and means for separating the product parts, wherein the receiving unit comprises a first and a second friction element that are movable relative to one another, wherein the two friction elements are arranged on the receiving unit such that the product can be arranged and firmly clamped between the friction elements, and the friction elements are designed such that the static friction between the product part and the friction element assigned to this is greater than the static friction between the product parts, so that the product parts can be moved with respect to one another given a relative movement between the two friction elements firmly clamping the product, wherein the receiving unit comprises a pressing device with a pivot device, by way of which means the first friction element can be pressed against the second friction element, wherein the pivot device comprises a pivot element mounted on a guide pivot, by way of which pivot element the first friction element can be pivoted to the second friction element, wherein the pivot element is pivotably, as well as axially displaceably mounted with respect to the guide pivot.

2. The device according to claim 1, wherein the device comprises a retaining device with a retaining element for acting on at least one of the product parts for the purpose of maintaining the separation of the product parts.

3. The device according to claim 2, wherein the retaining device is a clamping device, and the retaining element is a clamping limb for the clamped holding of the one product part on the receiving unit.

4. The device according to claim 1, wherein the friction elements in each case form a contact surface, and the contact surfaces are designed such that the static friction coefficient in each case between the contact surface and the product part is greater than the static friction coefficient between the product parts.

5. The device according to claim 1, wherein the receiving unit comprises a compartment or at least a part of a compartment, for receiving the product.

6. The device according to claim 1, wherein the friction elements in the active position are arranged at least partly lying opposite one another.

7. The device according to claim 1, wherein the receiving unit comprises an activation device, by way of which the two friction elements can be moved relative to one another.

8. The device according to claim 1, wherein the retaining device, the pressing device and/or the activation device can be actuated via a guide mechanism.

9. The device according to claim 1, wherein the device is an insertion device with receiving units led in a circulating manner.

10. A method for separating a product part of a multipart, flat product by way of a device, the method comprising the steps of:

introducing a product into a receiving unit, wherein the product parts are arranged between first and second friction elements;

pivoting a pivot element about a guide pivot and thereby pressing the first friction element against the second friction element and clamping the product arranged therebetween;

axially displacing the pivot element along the guide pivot and thereby moving the first friction element with respect to the second friction element transversely to a pressing direction and displacing the product parts with respect to one another, so that the one product part in each case forms an exposed region with respect to the other product part;

introducing a retaining element into the exposed region;

releasing the clamping of the product by pivoting back the pivot element and thereby restoring the first friction element.

* * * * *